US009398666B2

(12) United States Patent
Gandhi et al.

(10) Patent No.: US 9,398,666 B2
(45) Date of Patent: Jul. 19, 2016

(54) REFLECTIVE AND TRANSFLECTIVE OPERATION MODES FOR A DISPLAY DEVICE

(75) Inventors: Jignesh Gandhi, Burlington, MA (US); Nesbitt W. Hagood, IV, Wellesley, MA (US); Mark Douglas Halfman, Newtonville, MA (US); Je Hong Kim, Lexington, MA (US)

(73) Assignee: Pixtronix, Inc., San Diego, CA (US)

( * ) Notice: Subject to any disclaimer, the term of this patent is extended or adjusted under 35 U.S.C. 154(b) by 522 days.

(21) Appl. No.: 13/583,586

(22) PCT Filed: Mar. 11, 2011

(86) PCT No.: PCT/US2011/028143

§ 371 (c)(1),
(2), (4) Date: Oct. 26, 2012

(87) PCT Pub. No.: WO2011/112962

PCT Pub. Date: Sep. 15, 2011

(65) Prior Publication Data

US 2013/0082607 A1 Apr. 4, 2013

Related U.S. Application Data

(60) Provisional application No. 61/339,946, filed on Mar. 11, 2010.

(51) Int. Cl.

| | |
|---|---|
| ***H05B 37/02*** | (2006.01) |
| ***G09G 3/34*** | (2006.01) |
| *G09G 3/20* | (2006.01) |

(52) U.S. Cl.

CPC ..... *H05B 37/02* (2013.01); *G09G 3/3413* (2013.01); *G09G 3/3433* (2013.01); *G09G 3/2022* (2013.01); *G09G 2300/0456* (2013.01); *G09G 2300/08* (2013.01); *G09G 2310/0235* (2013.01);

(Continued)

(58) Field of Classification Search
CPC combination set(s) only.
See application file for complete search history.

(56) References Cited

U.S. PATENT DOCUMENTS 4,559,535 A 12/1985 Watkins et al.
4,564,836 A 1/1986 Vuilleumier et al.

(Continued)

FOREIGN PATENT DOCUMENTS

CN 1323025 A 11/2001
EP 1 091 342 A2 4/2001

(Continued)

OTHER PUBLICATIONS

Lawrence, Dick, "Introduction to MIPI Display Serial Interface for SID Mobile Displays 2006", Society of Information Display Hot Topics Conference 2006 Mobile Displays, Conference Proceedings, San Diego, California, Oct. 5, 2006, pp. 1-17.

(Continued)

*Primary Examiner* — Van Chow
(74) *Attorney, Agent, or Firm* — Weaver Austin Villeneuve & Sampson LLP

(57) ABSTRACT

A direct-view display apparatus includes a transparent substrate, an internal light source, a plurality of light modulators coupled to the transparent substrate, and a controller for controlling the states of the plurality of light modulators and the internal light source. The controller is configured to cause the display to transition from one of a transmissive, reflective and transflective mode, to a second of said modes.

61 Claims, 21 Drawing Sheets

(52) U.S. Cl.
CPC .... *G09G 2330/021* (2013.01); *G09G 2360/144* (2013.01); *G09G 2360/16* (2013.01); *G09G 2370/04* (2013.01)

(56) References Cited

U.S. PATENT DOCUMENTS

| | | | |
|---|---|---|---|
| 5,061,049 | A | 10/1991 | Hornbeck |
| 5,062,689 | A | 11/1991 | Koehler |
| 5,093,652 | A | 3/1992 | Bull et al. |
| 5,096,279 | A | 3/1992 | Hornbeck et al. |
| 5,142,405 | A | 8/1992 | Hornbeck |
| 5,233,385 | A | 8/1993 | Sampsell |
| 5,233,459 | A | 8/1993 | Bozler et al. |
| 5,278,652 | A | 1/1994 | Urbanus et al. |
| 5,280,277 | A | 1/1994 | Hornbeck |
| 5,319,491 | A | 6/1994 | Selbrede |
| 5,339,116 | A | 8/1994 | Urbanus et al. |
| 5,359,345 | A | 10/1994 | Hunter |
| 5,452,024 | A | 9/1995 | Sampsell |
| 5,461,411 | A | 10/1995 | Florence et al. |
| 5,493,439 | A | 2/1996 | Engle |
| 5,497,172 | A | 3/1996 | Doherty et al. |
| 5,510,824 | A | 4/1996 | Nelson |
| 5,517,347 | A | 5/1996 | Sampsell |
| 5,523,803 | A | 6/1996 | Urbanus et al. |
| 5,526,051 | A | 6/1996 | Gove et al. |
| 5,548,301 | A | 8/1996 | Kornher et al. |
| 5,724,062 | A | 3/1998 | Hunter |
| 5,731,802 | A | 3/1998 | Aras et al. |
| 5,745,193 | A | 4/1998 | Urbanus et al. |
| 5,745,281 | A | 4/1998 | Yi et al. |
| 5,771,321 | A | 6/1998 | Stern |
| 5,784,189 | A | 7/1998 | Bozler et al. |
| 5,794,761 | A | 8/1998 | Renaud et al. |
| 5,835,256 | A | 11/1998 | Huibers |
| 5,986,796 | A | 11/1999 | Miles |
| 6,008,929 | A | 12/1999 | Akimoto et al. |
| 6,034,807 | A | 3/2000 | Little et al. |
| 6,046,840 | A | 4/2000 | Huibers |
| 6,172,797 | B1 | 1/2001 | Huibers |
| 6,201,633 | B1 | 3/2001 | Peeters et al. |
| 6,225,991 | B1 | 5/2001 | McKnight |
| 6,249,269 | B1 | 6/2001 | Blalock et al. |
| 6,288,824 | B1 | 9/2001 | Kastalsky |
| 6,300,154 | B2 | 10/2001 | Clark et al. |
| 6,323,834 | B1 | 11/2001 | Colgan et al. |
| 6,329,974 | B1 | 12/2001 | Walker et al. |
| 6,388,661 | B1 | 5/2002 | Richards |
| 6,424,329 | B1 | 7/2002 | Okita |
| 6,567,063 | B1 | 5/2003 | Okita |
| 6,600,474 | B1 | 7/2003 | Heines et al. |
| 6,633,301 | B1 | 10/2003 | Dallas et al. |
| 6,650,455 | B2 | 11/2003 | Miles |
| 6,671,078 | B2 | 12/2003 | Flanders et al. |
| 6,674,562 | B1 | 1/2004 | Miles |
| 6,680,792 | B2 | 1/2004 | Miles |
| 6,701,039 | B2 | 3/2004 | Bourgeois et al. |
| 6,762,743 | B2 | 7/2004 | Yoshihara et al. |
| 6,775,048 | B1 | 8/2004 | Starkweather et al. |
| 6,795,064 | B2 | 9/2004 | Walker et al. |
| 6,798,935 | B2 | 9/2004 | Bourgeois et al. |
| 6,844,959 | B2 | 1/2005 | Huibers et al. |
| 6,873,311 | B2 | 3/2005 | Yoshihara et al. |
| 6,879,307 | B1 | 4/2005 | Stern |
| 6,900,072 | B2 | 5/2005 | Patel et al. |
| 6,906,847 | B2 | 6/2005 | Huibers et al. |
| 6,911,964 | B2 | 6/2005 | Lee et al. |
| 6,969,635 | B2 | 11/2005 | Patel et al. |
| 6,980,349 | B1 | 12/2005 | Huibers et al. |
| 7,042,618 | B2 | 5/2006 | Selbrede et al. |
| 7,046,221 | B1 | 5/2006 | Malzbender |
| 7,050,219 | B2 | 5/2006 | Kimura |
| 7,057,790 | B2 | 6/2006 | Selbrede |
| 7,092,142 | B2 | 8/2006 | Selebrede et al. |
| 7,119,944 | B2 | 10/2006 | Patel et al. |
| 7,123,796 | B2 | 10/2006 | Steckl et al. |
| 7,198,982 | B2 | 4/2007 | Patel et al. |
| 7,215,459 | B2 | 5/2007 | Huibers et al. |
| 7,218,437 | B2 | 5/2007 | Selbrede |
| 7,227,677 | B2 | 6/2007 | Ravnkilde et al. |
| 7,274,416 | B2 | 9/2007 | Feenstra et al. |
| 7,315,294 | B2 | 1/2008 | Richards |
| 7,463,227 | B2 | 12/2008 | Van Gorkom |
| 7,839,356 | B2 | 11/2010 | Hagood et al. |
| 2002/0075249 | A1 | 6/2002 | Kubota et al. |
| 2003/0231160 | A1 | 12/2003 | Yoshihara et al. |
| 2004/0080484 | A1 | 4/2004 | Heines et al. |
| 2004/0227719 | A1 | 11/2004 | Chang et al. |
| 2004/0246275 | A1 | 12/2004 | Yoshihara et al. |
| 2004/0263502 | A1 | 12/2004 | Dallas et al. |
| 2005/0062708 | A1 | 3/2005 | Yoshihara et al. |
| 2005/0073471 | A1 | 4/2005 | Selbrede |
| 2005/0088404 | A1 | 4/2005 | Heines et al. |
| 2005/0104804 | A1 | 5/2005 | Feenstra et al. |
| 2005/0122560 | A1 | 6/2005 | Sampsell et al. |
| 2005/0168431 | A1 | 8/2005 | Chui |
| 2005/0206991 | A1 | 9/2005 | Chui et al. |
| 2005/0212734 | A1 | 9/2005 | Kimura |
| 2006/0044246 | A1 | 3/2006 | Mignard |
| 2006/0044928 | A1 | 3/2006 | Chui et al. |
| 2006/0061559 | A1 | 3/2006 | King |
| 2006/0066937 | A1 | 3/2006 | Chui |
| 2006/0132424 | A1 | 6/2006 | Foo et al. |
| 2006/0152476 | A1 | 7/2006 | Van Gorkom et al. |
| 2006/0172745 | A1 | 8/2006 | Knowles |
| 2006/0187528 | A1 | 8/2006 | Hagood et al. |
| 2006/0238443 | A1 | 10/2006 | Derichs |
| 2007/0047051 | A1 | 3/2007 | Selbrede et al. |
| 2007/0047887 | A1 | 3/2007 | Selbrede |
| 2007/0132972 | A1 | 6/2007 | Streefkerk et al. |
| 2007/0172171 | A1 | 7/2007 | Van Ostrand et al. |
| 2007/0205969 | A1 | 9/2007 | Hagood et al. |
| 2010/0020054 | A1 | 1/2010 | Jepsen |
| 2010/0128015 | A1* | 5/2010 | Feenstra et al. ..... 345/211 |
| 2010/0231614 | A1* | 9/2010 | Vieri et al. ..... 345/690 |
| 2013/0215093 | A1* | 8/2013 | Bergquist et al. ..... 345/207 |
| 2015/0015828 | A1* | 1/2015 | Kim et al. ..... 349/68 |

FOREIGN PATENT DOCUMENTS

| | | | |
|---|---|---|---|
| EP | 1531453 | A2 | 5/2005 |
| EP | 2233970 | A1 | 9/2010 |
| JP | H0283526 | U | 6/1990 |
| JP | H03120515 | A | 5/1991 |
| JP | 2000098348 | A | 4/2000 |
| JP | 2000105547 | A | 4/2000 |
| JP | 2000-147455 | | 5/2000 |
| JP | 2002131719 | A | 5/2002 |
| JP | 2004004828 | A | 1/2004 |
| JP | 2005148735 | A | 6/2005 |
| JP | 2007506150 | A | 3/2007 |
| TW | 200424632 | | 11/2004 |
| WO | WO-2005029449 | A1 | 3/2005 |
| WO | WO-2006/017129 | | 2/2006 |
| WO | WO-2006091738 | A1 | 8/2006 |
| WO | 2007/075882 | | 7/2007 |
| WO | WO-2007075832 | | 7/2007 |
| WO | WO-2008056276 | A1 | 5/2008 |
| WO | WO-2009065069 | A1 | 5/2009 |
| WO | 2009078194 | A1 | 6/2009 |

OTHER PUBLICATIONS

Akimoto et al, "15.1: A 0.9-in UXGA/HDTV FLC Microdisplay," SID 00 Digest, 194-197(2000).

Alt et al, "A Gray-Scale Addressing Technique for Thin-Film-Transistor/Liquid Crystal Displays," IBM J. Res. Develop., 36(1):11-22(Jan. 1992).

Bergquist et. al. "Field Sequential Colour Display with Adaptive Gamut", Society for Information Display, Digest of Technical Papers 2006, p. 1594.

Chino et. al. "Development of Wide-Color-Gamut Mobile Displays with Four-Primary-Color LCDs", Society of Information Display, Digest of Technical Papers 2006, p. 1221.

(56) References Cited

OTHER PUBLICATIONS

Clark et al, "FLC Microdisplays," Ferroelectrics, 246:97-110(2000).
den Boer, "Active Matrix Liquid Crystal Displays," Elsevier Science & Technology Books, ISBN #0750678135, Aug. 2005.
Doherty, D. et. al. "Pulse Width Modulation Control of DLP Projectors", TI Technical Journal 1998, No. 3, p. 115.
Feenstra et al, "Electrowetting Displays," Liquavista BV, http://www.liquavista.com/documents/electrowetting_displays_whitepaper.pdf, Retrieved on Aug. 17, 2006.
Hornbeck, "Digital Light Processing™: A New MEMS-Based Display Technology," Technical Digest of the IEEJ 14th Sensor Symposium, pp. 297-304 (Jun. 4-5, 1996).
Kunzman and G. Pettitt, "White Enhancement for Color Sequential DLP" Society for Information Display, Digest of Technical Papers 1998.
Lee et. al. "Integrated Amorphous Silicon Color Sensor on LCD Panel for LED Backlight Feedback Control System", Society for Information Display, Digest of Technical Papers 2005, p. 1376.
Markandey, V., et al., "Video Processing for DLP Display Systems," Texas Instruments Corporation, 2666:21-32 (Mar. 13, 1996).
Pasricha et. al. "Dynamic Backlight Adaptation for Low Power Handheld Devices" IEEE Design and Test v. 21, p. 398 (2004).
Ravnkilde et al, "Fabrication of Nickel Microshutter Arrays for Spatial Light Modulation," Meso 2002, also on their website: http://www2.mic.dtu.dk/research/mems/publications/Papers/Dicon_Meso2002.pdf (2002).
Takatori et al, "6.3: Field-Sequential Smectic LCD with TFT Pixel Amplifier," SID 01 Digest, 48-51(2001).
Wang et al, "Highly Space-Efficient Electrostatic Zigzag Transmissive Micro-Optic Switches for an Integrated MEMS Optical Display System" Transducers 03 Conference, 1:575-575 (Jun. 8-12, 2003).
"Color Management Controller with Integrated RGB Photosensor" Data Sheet, ADJD-J823, Avago Technologies Corp., Jun. 13, 2007.
Lee, S-Y et al, "66.3: Integrated Power -LED Module Driving System for Led Backlights," SID 07 Digest, pp. 1802-1805 (2007).
Lee, S-Y et al, "P-81: A Novel Design of High Efficiency Constant DC-DC Converters and Control system for LED Backlight in LDC Display," SID 06 Digest, pp. 510-513 (2006).
Liu, C-L et al, "66.2: High-Speed Driving Circuit Design for RGB-LED Backlight," SID 07 Digest of Technical Papers, pp. 1798-1801 (2007).
Koskela, T., "Powering Backlights in Portable Devices," Portable Design, pp. 36-40 (Aug. 2007).
"PrimeCell Color LCD Controller (PL111 ) Revision: r0p2", Technical Reference, ARM Ltd. (2003).
International Search Report and Written Opinion dated Jul. 6, 2011 in International Application No. PCT/IS2011/028143.
International Preliminary Report on Patentability dated Oct. 2, 2012 in International Application No. PCT/IS2011/028143.
"Product Sheet with LVDS display interface" retrieved on Dec. 19, 2012 at http://advancedsilicon.com/web/nc/products/consumer/consumperpo.html?print=1.
Japanese Office Action dated Jan. 12, 2016 issued in JP Application No. 2012-557287.
Japanese Office Action dated Nov. 17, 2015 issued in JP Application No. 2014-236811.

* cited by examiner

REFLECTIVE AND TRANSFLECTIVE OPERATION MODES FOR A DISPLAY DEVICE

REFERENCE TO RELATED APPLICATIONS

This application is a national stage filing under 35 U.S.C. §371 of International Application PCT/US2011/028143, filed on Mar. 11, 2011 which claims the benefit of U.S. Provisional Patent Application Ser. No. 61/339,946, filed on Mar. 11, 2010, all of which are incorporated by reference herein in their entirety. International Application No. PCT/US2011/028143 was published under PCT Article 21(2) in English.

BACKGROUND OF THE INVENTION

As mobile multi-media functionality grows rapidly, portable electronic devices are becoming a more integral part of peoples' daily lives. As such, mobile devices are increasingly required to provide high display performance in a variety of ambient light conditions and applications without sacrificing battery life. Additionally, as portable devices progressively include more features and become more complex, battery power increasingly becomes a limiting factor in the performance of such devices. Conventional displays for portable devices require that a user make trade offs between power consumption and display performance, and provide little control over display settings and power usage.

Recently, displays have been developed which can operate in multiple modes and harness ambient light to improve display performance. For example, such modes may include a transmissive mode, where light from a back light is modulated, a reflective mode where ambient light is modulated, and a transflective mode where both light from a backlight and a relatively large amount of ambient light are modulated to create an image. For example, U.S. Patent Application Publication No. 2010/0020054 to Jepsen describes an LCD display having pixels that include separate transmissive and reflective portions. As a result, the effective aperture ratio of the display in a transmissive mode is reduced in comparison to displays in which the whole pixel is transmissive. The LCD display of the Jepsen publication also separately controls both portions. The separate control functionality requires separate data interconnects and additional drivers to control each portion independently, which substantially adds to the complexity of the backplane design and further reduces the space on the chip for light transmission.

A need exists for portable device displays that can transition between transmissive, reflective and/or a range of transflective operating modes using the same data interconnects to control both reflective and transmissive outputs of a display. In addition, a need exists for a device which provides transmissive, reflective and/or a range of transflective operating modes without sacrificing the effective aperture ratio of the display.

SUMMARY OF THE INVENTION

According to one aspect, a direct-view display apparatus includes a transparent substrate, an internal light source, a plurality of light modulators coupled to the transparent substrate, and a controller for controlling the states of the plurality of light modulators and the internal light source. The controller is configured to cause the display to display at least one image in a transmissive mode of operation by illuminating the internal light source and outputting data signals indicative of desired states of the plurality of light modulators through a first set data voltage interconnects coupled to the plurality of light modulators such that the plurality of light modulators modulate light emitted by the internal light source. The controller is further configured to detect a signal instructing the display apparatus to transition to a reflective mode of operation, transition, in response to the signal, to the reflective mode of operation, and display at least one image in the reflective mode of operation by, while keeping the internal light source un-illimuniated, outputting data signals indicative of desired states of the plurality of light modulators through the same first set of data voltage interconnects to the plurality of light modulators to modulate light originating from the ambient.

In certain embodiments, in the transmissive mode, the plurality of light modulators modulate both light emitted by the internal light source and light originating from the ambient. In some aspects, the controller receives the signal as an input from a user. In some aspects, transitioning to the reflective mode reduces power consumption by the display apparatus. In certain embodiments, the controller is further configured to transition to an operating mode in which images are displayed with more colors than another operating mode of the display device. In some aspects, the controller derives the signal from information to be displayed by the display apparatus. In some aspects, the controller derives the signal from an amount of energy stored in a battery. In certain embodiments, displaying at least one image in the transmissive mode comprises modulating light output by the internal light source, in which the light output by the internal light source is of a first intensity.

In certain embodiments, the controller is configured to transition to a transflective mode of operation, in which at least about 30% of the light modulated by the light modulators originates from the ambient. In various embodiments, the controller is configured to detect ambient light and transition to the transflective mode of operation in response to the detected ambient light and adjust the first intensity based on the detected ambient light. In certain aspects, adjusting the first intensity comprises reducing the intensity of the internal light source. In some aspects, the controller is configured to transition to the reflective mode in response to a signal based on the detected ambient light.

In certain embodiments, displaying at least one image in the transmissive mode comprises modulating light in accordance with a first number of grayscale divisions for the image, and displaying at least one image in the transflective or reflective modes comprises modulating light in accordance with a second number of grayscale divisions, in which the second number of grayscale divisions is less than the first number of grayscale divisions. In certain aspects displaying at least one image in the reflective mode comprises modulating the image as a black and white image. In certain aspects, displaying at least one image in the reflective mode comprises modulating light with at least 3 grayscale divisions. In certain aspects displaying at least one image in the transflective mode comprises modulating the image as a black and white image. In certain aspects, displaying at least one image in the transflective mode comprises modulating light with at least 3 grayscale divisions.

In some embodiments, displaying at least one image in the transflective mode comprises modulating light to form a color image, in which the image is modulated with only 1 grayscale division per color. In certain aspects, displaying at least one image in the transflective mode includes modulating light to form a color image, in which the image is modulated with at least 2 grayscale divisions per color. In some embodiments, the internal light source includes at least first and second light sources corresponding to different colors, and the controller measures at least one color component of the detected ambient light and adjusts the first intensity of at least one of the first and second light sources based on the measurement of the at least one color component of the detected ambient light. In certain aspects, displaying at least one image in the transmissive mode comprises modulating the light according to a first frame rate. In some aspects, displaying at least one image in the transflective or reflective modes includes modulating light in accordance with a second frame rate, in which the second frame rate that is less than the first frame rate. In certain aspects, transitioning to the reflective mode of operation includes loading, from a memory, operating parameters corresponding to the reflective mode. In some aspects, displaying at least one image in the reflective mode comprises converting a color image into a black and white image for display.

In certain embodiments, displaying at least one image in the transmissive mode includes modulating the plurality of light modulators according to a first sequence of timing signals which control the loading of image data to the plurality of light modulators. In some aspects, displaying at least one image in the transflective or reflective modes includes modulating the plurality of light modulators according to the same first sequence of timing signals which control the loading of image data to the plurality of light modulators. In certain aspects, displaying at least one image in the transflective or reflective modes includes modulating the plurality of light modulators according to a second sequence of timing signals that is different from the first sequence. In certain aspects, displaying at least one image in the transflective or reflective modes includes loading a subset of image data to the plurality of light modulators.

In certain embodiments, a method for controlling a display apparatus as described above, includes displaying, by the display apparatus, at least one image in a transmissive mode of operation, detecting a signal instructing the display apparatus to transition to a reflective mode of operation, transitioning by the display apparatus, in response to said signal, to the reflective mode of operation, and displaying, by the display apparatus, at least one image in the reflective mode of operation. In some embodiments, the method further includes detecting a signal instructing the display apparatus to transition to a transflective mode of operation, transitioning by the display apparatus, in response to said signal, to the transflective mode of operation, and displaying, by the display apparatus, at least one image in the transflective mode of operation.

In certain embodiments, a display apparatus includes at least one internal light source, at least one reflective optical cavity for receiving ambient light and light emitted from the at least one internal light source, a plurality of light modulators for modulating light leaving the reflective optical cavity towards a viewer; and a controller. The controller is configured to display at least one image in a transmissive mode of operation by illuminating the internal light source and outputting data signals indicative of desired states of the plurality of light modulators such that the plurality of light modulators modulate light emitted by the internal light source. The controller is further configured to detect a signal instructing the display apparatus to transition to a reflective mode of operation, transition, in response to the signal, to the reflective mode of operation, and display at least one image in the reflective mode of operation by, while keeping the internal light source un-illuminated, outputting data signals indicative of desired states of the plurality of light modulators to the plurality of light modulators to modulate light originating from the ambient.

In some embodiments, a plurality of data interconnects are coupled to the plurality of light modulators and the controller, in which the data interconnects are used to output data signals indicative of desired states of the plurality of light modulators. In certain aspects, in the transmissive mode, the plurality of light modulators modulate both light emitted by the internal light source and light originating from the ambient. In some aspects, in the transmissive mode the at least one internal light source outputs light with a first intensity.

In certain embodiments, the controller is configured to transition to a transflective mode in which at least about 30% of the light modulated by the light modulators originates from the ambient, wherein in the transflective mode, the controller outputs signals to control the plurality of light modulators to modulate both ambient light, and light emitted by the at least one internal light source. In some aspects, the light emitted by the at least one internal light source is at a lesser intensity than the first intensity, thereby increasing the percentage of ambient light output to a user.

In certain embodiments, the display apparatus includes a sensor for detecting and measuring ambient light. In some aspects, in the transflective mode, the controller decreases the intensity of the light emitted by the at least one internal light source based on at least one color component in the detected ambient light. In certain embodiments, the at least one optical cavity includes a rear-facing reflective layer and a front facing reflective layer.

In certain embodiments, a method for controlling a display apparatus as described above includes displaying, by the display apparatus, at least one image in a transmissive mode of operation, detecting a signal instructing the display apparatus to transition to a reflective mode of operation, transitioning by the display apparatus, in response to said signal, to the reflective mode of operation, and displaying, by the display apparatus, at least one image in the reflective mode of operation. In certain embodiments, the method includes detecting a signal instructing the display apparatus to transition to a transflective mode of operation, transitioning by the display apparatus, in response to said signal, to the transflective mode of operation, and displaying, by the display apparatus, at least one image in the transflective mode of operation.

BRIEF DESCRIPTION

In the detailed description which follows, reference will be made to the attached drawings, in which:

FIG. 4D is a timing diagram that corresponds to a coded-time division grayscale addressing process in which image frames are displayed by displaying four sub-frame images for each color component of the image frame according to an illustrative embodiment of the invention;

DESCRIPTION OF CERTAIN ILLUSTRATIVE EMBODIMENTS

Figure 1A:
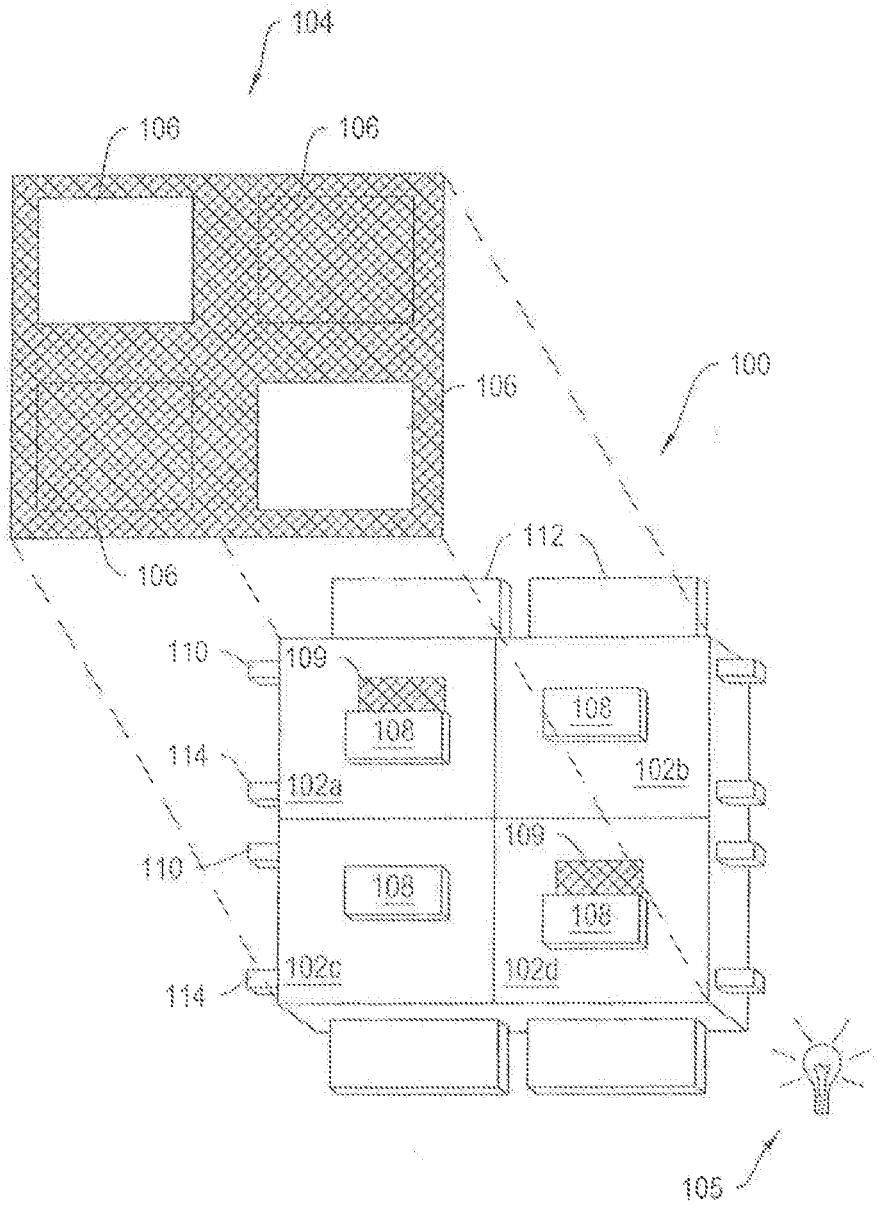
FIG. 1A is a schematic diagram of a direct-view MEMS-based display apparatus, according to an illustrative embodiment of the invention.

FIG. 1 is a schematic diagram of a direct-view MEMS-based display apparatus 100, according to an illustrative embodiment of the invention. The display apparatus 100 includes a plurality of light modulators 102*a*-102*d* (generally "light modulators 102") arranged in rows and columns. In the display apparatus 100, light modulators 102*a* and 102*d* are in the open state, allowing light to pass. Light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from outside of the apparatus. In certain embodiments, the apparatus 100 may form an image by modulating a combination of light from a backlight and from ambient light. In another implementation, the apparatus 100 may form an image by reflection of light from a lamp or lamps positioned in the front of the display, i.e. by use of a front light.

In the display apparatus 100, each light modulator 102 corresponds to a pixel 106 in the image 104. In other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide grayscale in an image 104. With respect to an image, a "pixel" corresponds to the smallest picture element defined by the resolution of image. With respect to structural components of the display apparatus 100, the term "pixel" refers to the combined mechanical and electrical components utilized to modulate the light that forms a single pixel of the image.

Display apparatus 100 is a direct-view display in that it does not require imaging optics that are necessary for projection applications. In a projection display, the image formed on the surface of the display apparatus is projected onto a screen or onto a wall. The display apparatus is substantially smaller than the projected image. In a direct view display, the user sees the image by looking directly at the display apparatus, which contains the light modulators and optionally a backlight or front light for enhancing brightness and/or contrast seen on the display.

Direct-view displays may operate in transmissive, reflective, or transflective modes. In a transmissive mode, the light modulators filter or selectively block light which originates from a lamp or lamps positioned behind the display. The light from the lamps is optionally injected into a lightguide or "backlight" so that each pixel can be uniformly illuminated. Transmissive direct-view displays are often built onto transparent or glass substrates to facilitate a sandwich assembly arrangement where one substrate, containing the light modulators, is positioned directly on top of the backlight. In a reflective mode, the light modulators filter or selectively block ambient light while the lamp or lamps positioned behind the display are turned off. In a transflective mode, the light modulators filter or selectively block both light which originates from a lamp or lamps positioned behind the display and ambient light. In certain embodiments, in transflective mode, the lamp intensity may be reduced without sacrificing display quality because the ambient light adds to the overall brightness of the image. In some cases, some ambient light is modulated in the transmissive mode. As used herein, a display device operating mode shall be considered transflective if greater than 30% and less than 100% of the total light modulated by the light modulators is ambient light.

Each light modulator 102 includes a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material in each light modulator 102.

The display apparatus also includes a control matrix connected to the substrate and to the light modulators for controlling the movement of the shutters. The control matrix includes a series of electrical interconnects (e.g., interconnects 110, 112, and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{we}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In other implementations, the data voltage pulses control switches, e.g., transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
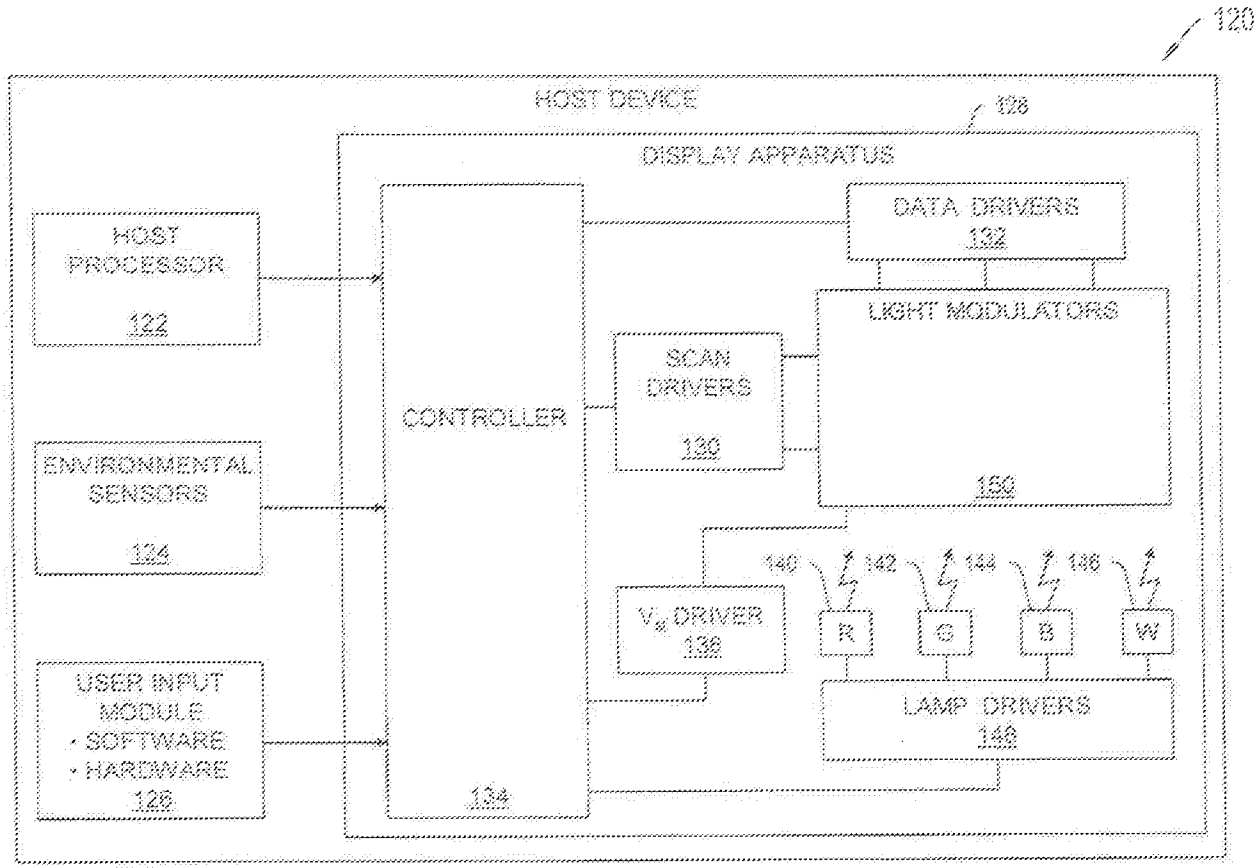
FIG. 1B is a block diagram of a host device according to an illustrative embodiment of the invention.

FIG. 1B is a block diagram 120 of a host device (i.e. cell phone, PDA, MP3 player, etc.). The host device includes a display apparatus 128, a host processor 122, environmental sensors 124, a user input module 126, and a power source.

The display apparatus 128 includes a plurality of scan drivers 130 (also referred to as "write enabling voltage sources"), a plurality of data drivers 132 (also referred to as "data voltage sources"), a controller 134, common drivers 138, lamps 140-146, and lamp drivers 148. The scan drivers 130 apply write enabling voltages to scan-line interconnects 110. The data drivers 132 apply data voltages to the data interconnects 112.

In some embodiments of the display apparatus, the data drivers 132 are configured to provide analog data voltages to the light modulators, especially where the gray scale of the image 104 is to be derived in analog fashion. In analog operation the light modulators 102 are designed such that when a range of intermediate voltages is applied through the data interconnects 112 there results a range of intermediate open states in the shutters 108 and therefore a range of intermediate illumination states or gray scales in the image 104. In other cases the data drivers 132 are configured to apply only a reduced set of 2, 3, or 4 digital voltage levels to the data interconnects 112. These voltage levels are designed to set, in digital fashion, an open state, a closed state, or other discrete state to each of the shutters 108.

The scan drivers 130 and the data drivers 132 are connected to a digital controller circuit 134 (also referred to as the "controller 134"). The controller sends data to the data drivers 132 in a mostly serial fashion, organized in predetermined sequences grouped by rows and by image frames. The data drivers 132 can include series to parallel data converters, level shifting, and for some applications digital to analog voltage converters.

The display 100 apparatus optionally includes a set of common drivers 138, also referred to as common voltage sources. In some embodiments the common drivers 138 provide a DC common potential to all light modulators within the array of light modulators, for instance by supplying voltage to a series of common interconnects 114. In other embodiments the common drivers 138, following commands from the controller 134, issue voltage pulses or signals to the array of light modulators, for instance global actuation pulses which are capable of driving and/or initiating simultaneous actuation of all light modulators in multiple rows and columns of the array.

All of the drivers (e.g., scan drivers 130, data drivers 132, and common drivers 138) for different display functions are time-synchronized by the controller 134. Timing commands from the controller coordinate the illumination of red, green and blue and white lamps (140, 142, 144, and 146 respectively) via lamp drivers 148, the write-enabling and sequencing of specific rows within the array of pixels, the output of voltages from the data drivers 132, and the output of voltages that provide for light modulator actuation.

The controller 134 determines the sequencing or addressing scheme by which each of the shutters 108 can be re-set to the illumination levels appropriate to a new image 104. Details of suitable addressing, image formation, and gray scale techniques can be found in U.S. Patent Application Publication Nos. US 200760250325 A1 and US 20015005969 A1 incorporated herein by reference. New images 104 can be set at periodic intervals. For instance, for video displays, the color images 104 or frames of video are refreshed at frequencies ranging from 10 to 300 Hertz. In some embodiments the setting of an image frame to the array is synchronized with the illumination of the lamps 140, 142, 144, and 146 such that alternate image frames are illuminated with an alternating series of colors, such as red, green, and blue. The image frames for each respective color is referred to as a color sub-frame. In this method, referred to as the field sequential color method, if the color sub-frames are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 134 forms an image by the method of time division gray scale, as previously described. In other implementations the display apparatus 100 can provide gray scale through the use of multiple shutters 108 per pixel.

In some implementations the data for an image state 104 is loaded by the controller 134 to the modulator array by a sequential addressing of individual rows, also referred to as scan lines. For each row or scan line in the sequence, the scan driver 130 applies a write-enable voltage to the write enable interconnect 110 for that row of the array, and subsequently the data driver 132 supplies data voltages, corresponding to desired shutter states, for each column in the selected row. This process repeats until data has been loaded for all rows in the array. In some implementations the sequence of selected rows for data loading is linear, proceeding from top to bottom in the array. In other implementations the sequence of selected rows is pseudo-randomized, in order to minimize visual artifacts. And in other implementations the sequencing is organized by blocks, where, for a block, the data for only a certain fraction of the image state 104 is loaded to the array, for instance by addressing only every $5^{th}$ row of the array in sequence.

In some implementations, the process for loading image data to the array is separated in time from the process of actuating the shutters 108. In these implementations, the modulator array may include data memory elements for each pixel in the array and the control matrix may include a global actuation interconnect for carrying trigger signals, from common driver 138, to initiate simultaneous actuation of shutters 108 according to data stored in the memory elements. Various addressing sequences, many of which are described in U.S. patent application Ser. No. 11/643,042, can be coordinated by means of the controller 134.

In alternative embodiments, the array of pixels and the control matrix that controls the pixels may be arranged in configurations other than rectangular rows and columns. For example, the pixels can be arranged in hexagonal arrays or curvilinear rows and columns. In general, as used herein, the term scan-line shall refer to any plurality of pixels that share a write-enabling interconnect.

The host processor 122 generally controls the operations of the host. For example, the host processor may be a general or special purpose processor for controlling a portable electronic device. With respect to the display apparatus 128, included within the host device 120, the host processor outputs image data as well as additional data about the host. Such information may include data from environmental sensors, such as ambient light or temperature; information about the host, including, for example, an operating mode of the host or the amount of power remaining in the host's power source; information about the content of the image data; information about the type of image data; and/or instructions for display apparatus for use in selecting an imaging mode.

The user input module 126 conveys the personal preferences of the user to the controller 134, either directly, or via the host processor 122. In one embodiment, the user input module is controlled by software in which the user programs personal preferences such as "deeper color", "better contrast", "lower power", "increased brightness", "sports", "live action", or "animation". In another embodiment, these preferences are input to the host using hardware, such as a switch or dial. The plurality of data inputs to the controller 134 direct the controller to provide data to the various drivers 130, 132, 138, and 148 which correspond to optimal imaging characteristics.

An environmental sensor module 124 is also included as part of the host device. The environmental sensor module receives data about the ambient environment, such as temperature and or ambient lighting conditions. The sensor module 124 can be programmed to distinguish whether the device is operating in an indoor or office environment versus an outdoor environment in bright daylight versus and outdoor environment at nighttime. The sensor module communicates this information to the display controller 134, so that the controller can optimize the viewing conditions and/or display modes in response to the ambient environment.

Figure 2A:
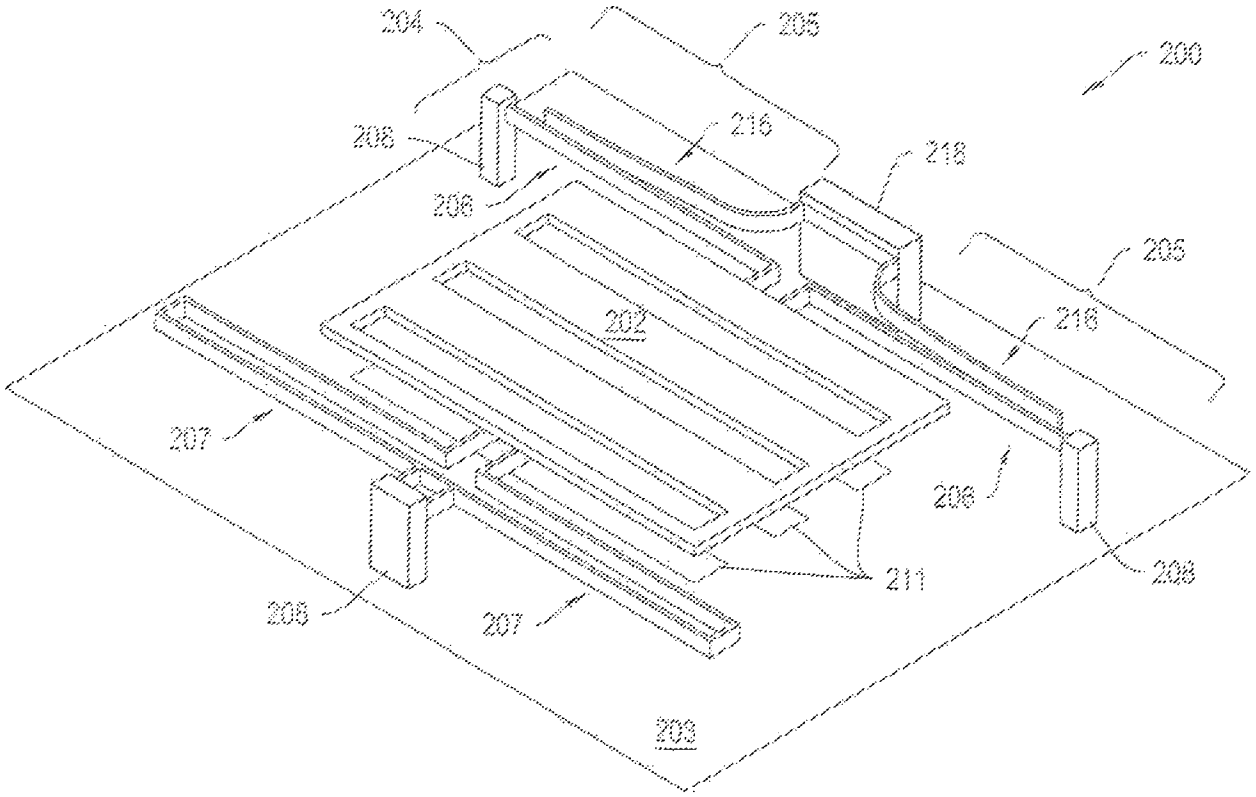
FIG. 2A is a perspective view of an illustrative shutter-based light modulator suitable for incorporation into the direct-view MEMS-based display apparatus of FIG. 1A, according to an illustrative embodiment of the invention.

FIG. 2A is a perspective view of an illustrative shutter-based light modulator 200 suitable for incorporation into the direct-view MEMS-based display apparatus 100 of FIG. 1A, according to an illustrative embodiment of the invention. The light modulator 200 includes a shutter 202 coupled to an actuator 204. The actuator 204 is formed from two separate compliant electrode beam actuators 205 (the "actuators 205"), as described in U.S. Pat. No. 7,271,945 filed on Oct. 14, 2005. The shutter 202 couples on one side to the actuators 205. The actuators 205 move the shutter 202 transversely over a surface 203 in a plane of motion which is substantially parallel to the surface 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the surface 203. The surface includes one or more aperture holes 211 for admitting the passage of light. The load anchors 208 physically connect the compliant load beams 206 and the shutter 202 to the surface 203 and electrically connect the load beams 206 to a bias voltage, in some instances, ground.

If the substrate is opaque, such as silicon, then aperture holes 211 are formed in the substrate by etching an array of holes through the substrate 204. If the substrate 204 is transparent, such as glass or plastic, then the first step of the processing sequence involves depositing a light blocking layer onto the substrate and etching the light blocking layer into an array of holes 211. The aperture holes 211 can be generally circular, elliptical, polygonal, serpentine, or irregular in shape.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely towards the drive anchor 218. The compliant members 206 act as springs, such that when the voltage across the beams 206 and 216 potential is removed, the load beams 206 push the shutter 202 back into its initial position, releasing the stress stored in the load beams 206.

A light modulator, such as light modulator 200, incorporates a passive restoring force, such as a spring, for returning a shutter to its rest position after voltages have been removed. Other shutter assemblies, as described in U.S. Pat. No. 7,271,945 and patent application publication No. US2006-0250325 A1, incorporate a dual set of "open" and "closed" actuators and a separate sets of "open" and "closed" electrodes for moving the shutter into either an open or a closed state.

U.S. Pat. No. 7,271,945 and application publication No. US2006-0250325 A1 have described a variety of methods by which an array of shutters and apertures can be controlled via a control matrix to produce images, in many cases moving images, with appropriate gray scale. In some cases control is accomplished by means of a passive matrix array of row and column interconnects connected to driver circuits on the periphery of the display. In other cases it is appropriate to include switching and/or data storage elements within each pixel of the array (the so-called active matrix) to improve either the speed, the gray scale and/or the power dissipation performance of the display.

Figure 2B:
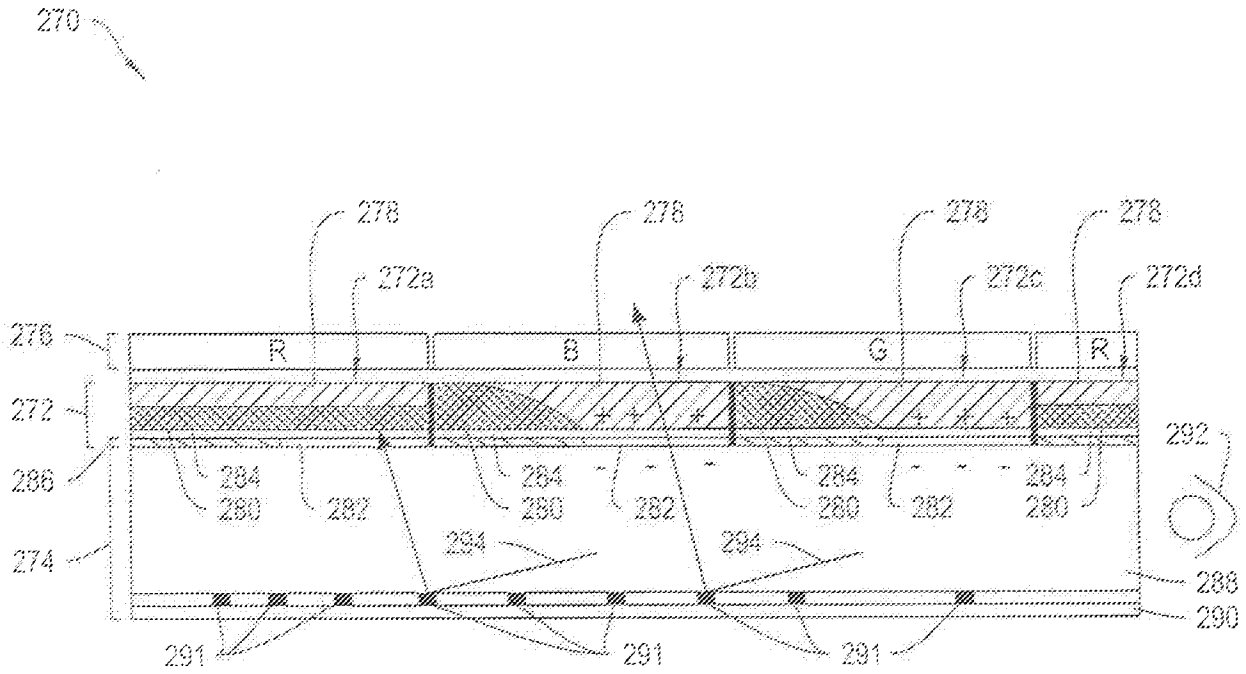
FIG. 2B is a cross sectional view of an illustrative non-shutter-based light modulator suitable for inclusion in various embodiments of the invention.

The control matrices described herein are not limited to controlling shutter-based MEMS light modulators, such as the light modulators described above. FIG. 2B is a cross sectional view of an illustrative non-shutter-based light modulator suitable for inclusion in various embodiments of the invention. Specifically, FIG. 2B is a cross sectional view of an electrowetting-based light modulation array 270. The light modulation array 270 includes a plurality of electrowetting-based light modulation cells 272*a*-272B (generally "cells 272") formed on an optical cavity 274. The light modulation array 270 also includes a set of color filters 276 corresponding to the cells 272.

Each cell 272 includes a layer of water (or other transparent conductive or polar fluid) 278, a layer of light absorbing oil 280, a transparent electrode 282 (made, for example, from indium-tin oxide) and an insulating layer 284 positioned between the layer of light absorbing oil 280 and the transparent electrode 282. Illustrative implementation of such cells are described further in U.S. Patent Application Publication No. 2005/0104804, published May 19, 2005 and entitled "Display Device." In the embodiment described herein, the electrode takes up a portion of a rear surface of a cell 272.

The remainder of the rear surface of a cell 272 is formed from a reflective aperture layer 286 that forms the front surface of the optical cavity 274. The reflective aperture layer 286 is formed from a reflective material, such as a reflective metal or a stack of thin films forming a dielectric mirror. For each cell 272, an aperture is formed in the reflective aperture layer 286 to allow light to pass through. The electrode 282 for the cell is deposited in the aperture and over the material forming the reflective aperture layer 286, separated by another dielectric layer.

The remainder of the optical cavity 274 includes a light guide 288 positioned proximate the reflective aperture layer 286, and a second reflective layer 290 on a side of the light guide 288 opposite the reflective aperture layer 286. A series of light redirectors 291 are formed on the rear surface of the light guide, proximate the second reflective layer. The light redirectors 291 may be either diffuse or specular reflectors. One of more light sources 292 inject light 294 into the light guide 288.

In an alternative implementation, an additional transparent substrate is positioned between the light guide 290 and the light modulation array 270. In this implementation, the reflective aperture layer 286 is formed on the additional transparent substrate instead of on the surface of the light guide 290.

In operation, application of a voltage to the electrode 282 of a cell (for example, cell 272*b* or 272*c*) causes the light absorbing oil 280 in the cell to collect in one portion of the cell 272. As a result, the light absorbing oil 280 no longer obstructs the passage of light through the aperture formed in the reflective aperture layer 286 (see, for example, cells 272*b* and 272*c*). Light escaping the backlight at the aperture is then able to escape through the cell and through a corresponding color (for example, red, green, or blue) filter in the set of color filters 276 to form a color pixel in an image. When the electrode 282 is grounded, the light absorbing oil 280 covers the aperture in the reflective aperture layer 286, absorbing any light 294 attempting to pass through it.

The area under which oil 280 collects when a voltage is applied to the cell 272 constitutes wasted space in relation to forming an image. This area cannot pass light through, whether a voltage is applied or not, and therefore, without the inclusion of the reflective portions of reflective apertures layer 286, would absorb light that otherwise could be used to contribute to the formation of an image. However, with the inclusion of the reflective aperture layer 286, this light, which otherwise would have been absorbed, is reflected back into the light guide 290 for future escape through a different aperture. The electrowetting-based light modulation array 270 is not the only example of a non-shutter-based MEMS modulator suitable for control by the control matrices described herein. Other forms of non-shutter-based MEMS modulators could likewise be controlled by various ones of the control matrices described herein without departing from the scope of the invention.

Figure 2C:
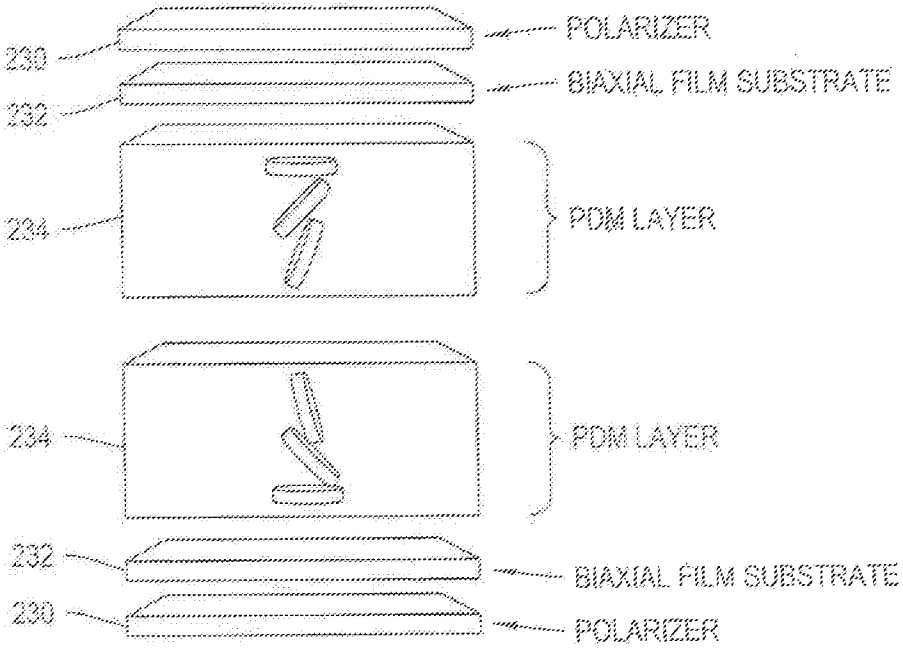
FIG. 2C is an example of a field sequential liquid crystal display operating in optically compensated bend (OCB) mode.

In addition to MEMS displays, the invention may also make use of field sequential liquid crystal displays, including for example, liquid crystal displays operating in optically compensated bend (OCB) mode as shown in FIG. 2C. Coupling an OCB mode LCD display with the field sequential color method allows for low power and high resolution displays. The LCD of FIG. 2C is composed of a circular polarizer 230, a biaxial retardation film 232, and a polymerized discotic material (PDM) 234. The biaxial retardation film 232 contains transparent surface electrodes with biaxial transmission properties. These surface electrodes act to align the liquid crystal molecules of the PDM layer in a particular direction when a voltage is applied across them. The use of field sequential LCD's are described in more detail in T. Ishinabe et. al., "High Performance OCB-mode for Field Sequential Color LCDs", *Society for Information Display Digest of Technical Papers,* 987 (2007). which is incorporated herein by reference.

Figure 3A:
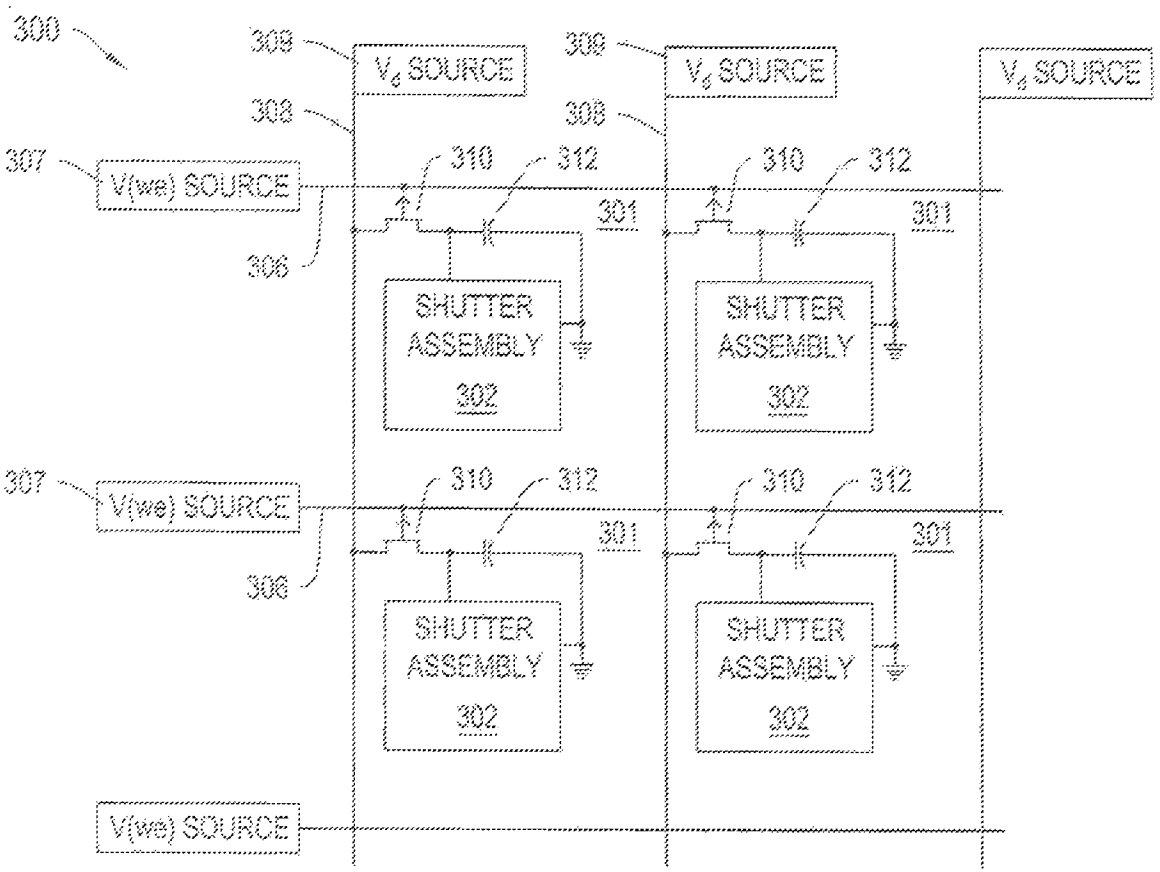
FIG. 3A is a schematic diagram of a control matrix suitable for controlling the light modulators incorporated into the MEMS-based display of FIG. 1A, according to an illustrative embodiment of the invention.
Figure 3B:
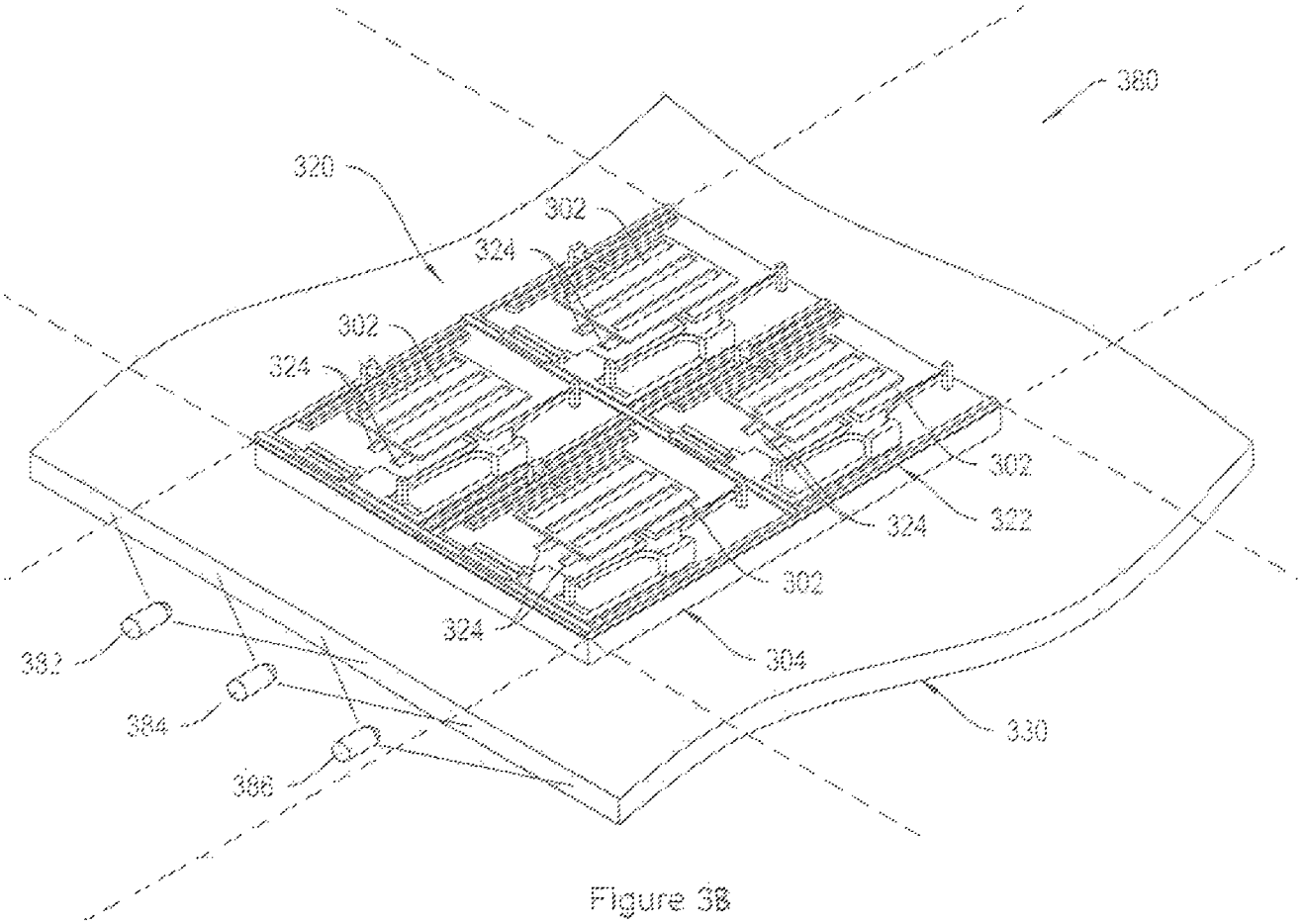
FIG. 3B is a perspective view of an array of shutter-based light modulators, according to an illustrative embodiment of the invention.

FIG. 3A is a schematic diagram of a control matrix 300 suitable for controlling the light modulators incorporated into the MEMS-based display apparatus 100 of FIG. 1A, according to an illustrative embodiment of the invention. FIG. 3B is a perspective view of an array 320 of shutter-based light modulators connected to the control matrix 300 of FIG. 3A, according to an illustrative embodiment of the invention. The control matrix 300 may address an array of pixels 320 (the "array 320"). Each pixel 301 includes an elastic shutter assembly 302, such as the shutter assembly 200 of FIG. 2A, controlled by an actuator 303. Each pixel also includes an aperture layer 322 that includes apertures 324. Further electrical and mechanical descriptions of shutter assemblies such as shutter assembly 302, and variations thereon, can be found in U.S. patent application Ser. Nos. 11/251,035 and 11/326,696. Descriptions of alternate control matrices can also be found in U.S. patent application Ser. No. 11/607,715.

The control matrix 300 is fabricated as a diffused or thin-film-deposited electrical circuit on the surface of a substrate 304 on which the shutter assemblies 302 are formed. The control matrix 300 includes a scan-line interconnect 306 for each row of pixels 301 in the control matrix 300 and a data-interconnect 308 for each column of pixels 301 in the control matrix 300. Each scan-line interconnect 306 electrically connects a write-enabling voltage source 307 to the pixels 301 in a corresponding row of pixels 301. Each data interconnect 308 electrically connects a data voltage source, ("Vd source") 309 to the pixels 301 in a corresponding column of pixels 301. In control matrix 300, the data voltage Vd provides the majority of the energy necessary for actuation of the shutter assemblies 302. Thus, the data voltage source 309 also serves as an actuation voltage source.

Referring to FIGS. 3A and 3B, for each pixel 301 or for each shutter assembly 302 in the array of pixels 320, the control matrix 300 includes a transistor 310 and a capacitor 312. The gate of each transistor 310 is electrically connected to the scan-line interconnect 306 of the row in the array 320 in which the pixel 301 is located. The source of each transistor 310 is electrically connected to its corresponding data interconnect 308. In certain embodiments, the same data interconnect 308 provides shutter transition instructions for both transmissive and reflective modes. The actuators 303 of each shutter assembly 302 include two electrodes. The drain of each transistor 310 is electrically connected in parallel to one electrode of the corresponding capacitor 312 and to one of the electrodes of the corresponding actuator 303. The other electrode of the capacitor 312 and the other electrode of the actuator 303 in shutter assembly 302 are connected to a common or ground potential. In alternate implementations, the transistors 310 can be replaced with semiconductor diodes and or metal-insulator-metal sandwich type switching elements.

In operation, to form an image, the control matrix 300 write-enables each row in the array 320 in a sequence by applying Vwe to each scan-line interconnect 306 in turn. For a write-enabled row, the application of Vwe to the gates of the transistors 310 of the pixels 301 in the row allows the flow of current through the data interconnects 308 through the transistors 310 to apply a potential to the actuator 303 of the shutter assembly 302. While the row is write-enabled, data voltages Vd are selectively applied to the data interconnects 308. In implementations providing analog gray scale, the data voltage applied to each data interconnect 308 is varied in relation to the desired brightness of the pixel 301 located at the intersection of the write-enabled scan-line interconnect 306 and the data interconnect 308. In implementations providing digital control schemes, the data voltage is selected to be either a relatively low magnitude voltage (i.e., a voltage near ground) or to meet or exceed Vat (the actuation threshold voltage). In response to the application of Vat to a data interconnect 308, the actuator 303 in the corresponding shutter assembly 302 actuates, opening the shutter in that shutter assembly 302. The voltage applied to the data interconnect 308 remains stored in the capacitor 312 of the pixel 301 even after the control matrix 300 ceases to apply Vwe to a row. It is not necessary, therefore, to wait and hold the voltage Vwe on a row for times long enough for the shutter assembly 302 to actuate; such actuation can proceed after the write-enabling voltage has been removed from the row. The capacitors 312 also function as memory elements within the array 320, storing actuation instructions for periods as long as is necessary for the illumination of an image frame.

The pixels 301 as well as the control matrix 300 of the array 320 are formed on a substrate 304. The array includes an aperture layer 322, disposed on the substrate 304, which includes a set of apertures 324 for respective pixels 301 in the array 320. The apertures 324 are aligned with the shutter assemblies 302 in each pixel. In one implementation the substrate 304 is made of a transparent material, such as glass or plastic. In another implementation the substrate 304 is made of an opaque material, but in which holes are etched to form the apertures 324.

Components of shutter assemblies 302 are processed either at the same time as the control matrix 300 or in subsequent processing steps on the same substrate. The electrical components in control matrix 300 are fabricated using many thin film techniques in common with the manufacture of thin film transistor arrays for liquid crystal displays. Available techniques are described in Den Boer, Active Matrix Liquid Crystal Displays (Elsevier, Amsterdam, 2005), incorporated herein by reference. The shutter assemblies are fabricated using techniques similar to the art of micromachining or from the manufacture of micromechanical (i.e., MEMS) devices. Many applicable thin film MEMS techniques are described in Rai-Choudhury, ed., Handbook of Microlithography, Micromachining & Microfabrication (SPIE Optical Engineering Press, Bellingham, Wash. 1997), incorporated herein by reference. Fabrication techniques specific to MEMS light modulators formed on glass substrates can be found in U.S. patent application Ser. Nos. 11/361,785 and 11/731,628, incorporated herein by reference. For instance, as described in those applications, the shutter assembly 302 can be formed from thin films of amorphous silicon, deposited by a chemical vapor deposition process.

The shutter assembly 302 together with the actuator 303 can be made bi-stable. That is, the shutters can exist in at least two equilibrium positions (e.g. open or closed) with little or no power required to hold them in either position. More particularly, the shutter assembly 302 can be mechanically bi-stable. Once the shutter of the shutter assembly 302 is set in position, no electrical energy or holding voltage is required to maintain that position. The mechanical stresses on the physical elements of the shutter assembly 302 can hold the shutter in place.

The shutter assembly 302 together with the actuator 303 can also be made electrically bi-stable. In an electrically bi-stable shutter assembly, there exists a range of voltages below the actuation voltage of the shutter assembly, which if applied to a closed actuator (with the shutter being either open or closed), holds the actuator closed and the shutter in position, even if an opposing force is exerted on the shutter. The opposing force may be exerted by a spring such as spring 207 in shutter-based light modulator 200, or the opposing force may be exerted by an opposing actuator, such as an "open" or "closed" actuator.

The light modulator array 320 is depicted as having a single MEMS light modulator per pixel. Other embodiments are possible in which multiple MEMS light modulators are provided in each pixel, thereby providing the possibility of more than just binary "on' or "off" optical states in each pixel. Certain forms of coded area division gray scale are possible where multiple MEMS light modulators in the pixel are provided, and where apertures 324, which are associated with each of the light modulators, have unequal areas.

In other embodiments the roller-based light modulator 220, the light tap 250, or the electrowetting-based light modulation array 270, as well as other MEMS-based light modulators, can be substituted for the shutter assembly 302 within the light modulator array 320.

FIG. 3B is a perspective view of an array 320 of shutter-based light modulators, according to an illustrative embodiment of the invention. FIG. 3B also illustrates the array of light modulators 320 disposed on top of backlight 330. In one implementation, the backlight 330 is made of a transparent material, i.e. glass or plastic, and functions as a light guide for evenly distributing light from lamps 382, 384, and 386 throughout the display plane. When assembling the display 380 as a field sequential display, the lamps 382, 384, and 386 can be alternate color lamps, e.g. red, green, and blue lamps respectively.

A number of different types of lamps 382-386 can be employed in the displays, including without limitation: incandescent lamps, fluorescent lamps, lasers, or light emitting diodes (LEDs). Further, lamp 382-386 of direct view display 380 can be combined into a single assembly containing multiple lamps. For instance a combination of red, green, and blue LEDs can be combined with or substituted for a white LED in a small semiconductor chip, or assembled into a small multi-lamp package. Similarly each lamp can represent an assembly of 4-color LEDs, for instance a combination of red, yellow, green, and blue LEDs.

The shutter assemblies 302 function as light modulators. By use of electrical signals from the associated control matrix the shutter assemblies 302 can be set into either an open or a closed state. Only the open shutters allow light from the lightguide 330 to pass through to the viewer, thereby forming a direct view image in transmissive mode.

In direct view display 380 the light modulators are formed on the surface of substrate 304 that faces away from the light guide 330 and toward the viewer. In other implementations the substrate 304 can be reversed, such that the light modulators are formed on a surface that faces toward the light guide. In these implementations it is sometimes preferable to form an aperture layer, such as aperture layer 322, directly onto the top surface of the light guide 330. In other implementations it is useful to interpose a separate piece of glass or plastic between the light guide and the light modulators, such separate piece of glass or plastic containing an aperture layer, such as aperture layer 322, and associated aperture holes, such as aperture holes 324. It is preferable that the spacing between the plane of the shutter assemblies 302 and the aperture layer 322 be kept as close as possible, preferably less than 10 microns, in some cases as close as 1 micron. Descriptions of other optical assemblies useful for this invention can be found in US Patent Application Publication No. 20060187528A1 filed Sep. 2, 2005 and entitled "Methods and Apparatus for Spatial Light Modulation" and in U.S. Patent Application Publication No. US 2007-0279727 A1 published Dec. 6, 2007 and entitled "Display Apparatus with Improved Optical Cavities," which are both incorporated herein by reference.

In some displays, color pixels are generated by illuminating groups of light modulators corresponding to different colors, for example, red green and blue. Each light modulator in the group has a corresponding filter to achieve the desired color. The filters, however, absorb a great deal of light, in some cases as much as 60% of the light passing through the filters, thereby limiting the efficiency and brightness of the display. In addition, the use of multiple light modulators per pixel decreases the amount of space on the display that can be used to contribute to a displayed image, further limiting the brightness and efficiency of such a display.

The human brain, in response to viewing rapidly changing images, for example, at frequencies of greater than 20 Hz, averages images together to perceive an image which is the combination of the images displayed within a corresponding period. This phenomenon can be utilized to display color images while using only single light modulators for each pixel of a display, using a technique referred to in the art as field sequential color. The use of field sequential color techniques in displays eliminates the need for color filters and multiple light modulators per pixel. In a field sequential color enabled display, an image frame to be displayed is divided into a number of sub-frame images, each corresponding to a particular color component (for example, red, green, or blue) of the original image frame. For each sub-frame image, the light modulators of a display are set into states corresponding to the color component's contribution to the image. The light modulators then are illuminated by a lamp of the corresponding color. The sub-images are displayed in sequence at a frequency (for example, greater than 60 Hz) sufficient for the brain to perceive the series of sub-frame images as a single image. The data used to generate the sub-frames are often fractured in various memory components. For example, in some displays, data for a given row of display are kept in a shift-register dedicated to that row. Image data is shifted in and out of each shift register to a light modulator in a corresponding column in that row of the display according to a fixed clock cycle. Other implementations of circuits for controlling displays are described in U.S. Patent Publication No. US 2007-0086078 A1 published Apr. 19, 2007 and entitled "Circuits for Controlling Display Apparatus," which is incorporated herein by reference.

Figure 4A:
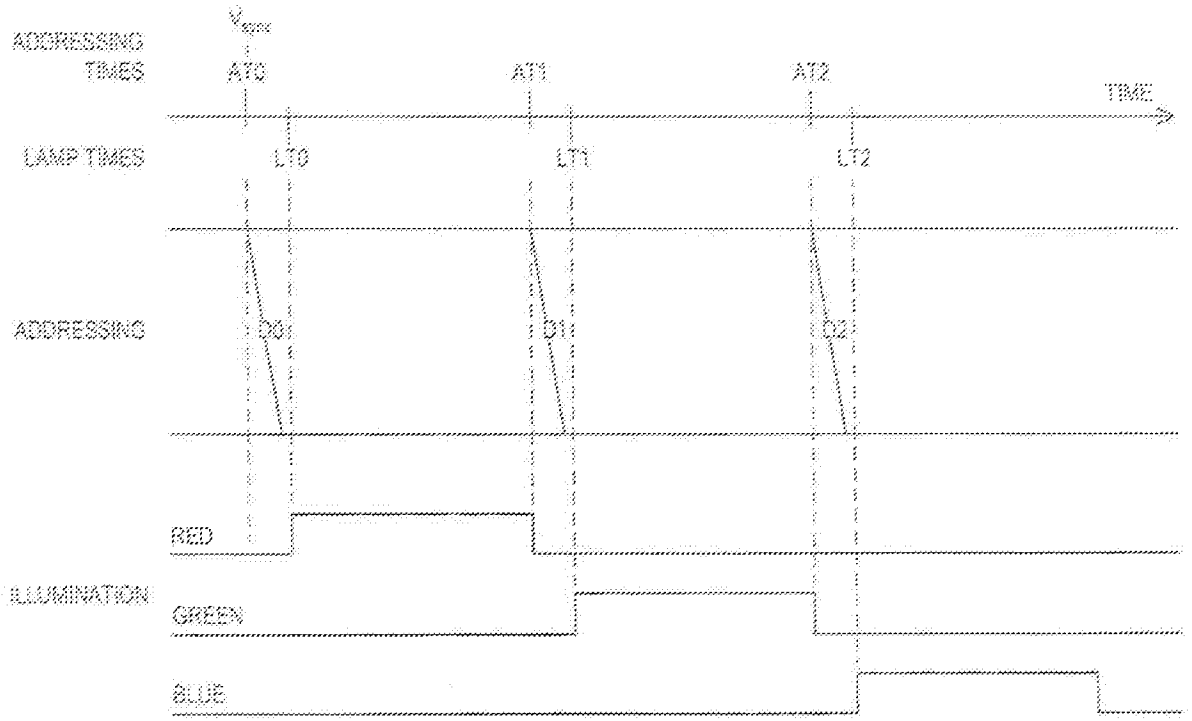
FIG. 4A is a timing diagram corresponding to a display process for displaying images using field sequential color according to an illustrative embodiment of the invention.

FIG. 4A is a timing diagram corresponding to a display process for displaying images using field sequential color, which can be implemented according to an illustrative embodiment of the invention, for example, by a MEMS direct-view display as described in the figures above. The timing diagrams included herein, including the timing diagrams of FIGS. 4B, 4C, 4D and 4E conform to the following conventions. The top portions of the timing diagrams illustrate light modulator addressing events. The bottom portions illustrate lamp illumination events.

The addressing portions depict addressing events by diagonal lines spaced apart in time. Each diagonal line corresponds to a series of individual data loading events during which data is loaded into each row of an array of light modulators, one row at a time. Depending on the control matrix used to address and drive the modulators included in the display, each loading event may require a waiting period to allow the light modulators in a given row to actuate. In some implementations, all rows in the array of light modulators are addressed prior to actuation of any of the light modulators. Upon completion of loading data into the last row of the array of light modulators, all light modulators are actuated substantially simultaneously.

Lamp illumination events are illustrated by pulse trains corresponding to each color of lamp included in the display. Each pulse indicates that the lamp of the corresponding color is illuminated, thereby displaying the sub-frame image loaded into the array of light modulators in the immediately preceding addressing event.

The time at which the first addressing event in the display of a given image frame begins is labeled on each timing diagram as AT0. In most of the timing diagrams, this time falls shortly after the detection of a voltage pulse vsync, which precedes the beginning of each video frame received by a display. The times at which each subsequent addressing event takes place are labeled as AT1, AT2, . . . AT(n−1), where n is the number of sub-frame images used to display the image frame. In some of the timing diagrams, the diagonal lines are further labeled to indicate the data being loaded into the array of light modulators. For example, in the timing diagram of FIG. 4, D0 represents the first data loaded into the array of light modulators for a frame and D(n−1) represents the last data loaded into the array of light modulators for the frame. In the timing diagrams of FIGS. 4B-4D, the data loaded during each addressing event corresponds to a bitplane.

A bitplane is a coherent set of data identifying desired modulator states for modulators in multiple rows and multiple columns of an array of light modulators. Moreover, each bitplane corresponds to one of a series of sub-frame images derived according to a binary coding scheme. That is, each sub-frame image for a color component of an image frame is weighted according to a binary series 1, 2, 4, 8, 16, etc. The bitplane with the lowest weighting is referred to as the least significant bitplane and is labeled in the timing diagrams and referred to herein by the first letter of the corresponding color component followed by the number 0. For each next-most significant bitplane for the color components, the number following the first letter of the color component increases by one. For example, for an image frame broken into 4 bitplanes per color, the least significant red bitplane is labeled and referred to as the R0 bitplane. The next most significant red bitplane is labeled and referred to as R1, and the most significant red bitplane is labeled and referred to as R3.

Lamp-related events are labeled as LT0, LT1, LT2 . . . LT(n−1). The lamp-related event times labeled in a timing diagram, depending on the timing diagram, either represent times at which a lamp is illuminated or times at which a lamp is extinguished. The meaning of the lamp times in a particular timing diagram can be determined by comparing their position in time relative to the pulse trains in the illumination portion of the particular timing diagram. Specifically referring back to the timing diagram of FIG. 4A, to display an image frame according to the timing diagram, a single sub-frame image is used to display each of three color components of an image frame. First, data, D0, indicating modulator states desired for a red sub-frame image are loaded into an array of light modulators beginning at time AT0. After addressing is complete, the red lamp is illuminated at time LT0, thereby displaying the red sub-frame image. Data, D1, indicating modulator states corresponding to a green sub-frame image are loaded into the array of light modulators at time AT1. A green lamp is illuminated at time LT1. Finally, data, D2, indicating modulator states corresponding to a blue sub-frame image are loaded into the array of light modulators and a blue lamp is illuminated at times AT2 and LT2, respectively. The process then repeats for subsequent image frames to be displayed.

The level of gray scale achievable by a display that forms images according to the timing diagram of FIG. 4A depends on how finely the state of each light modulator can be controlled. For example, if the light modulators are binary in nature, i.e., they can only be on or off, the display will be limited to generating 8 different colors. The level of gray scale can be increased for such a display by providing light modulators than can be driven into additional intermediate states. In some embodiments related to the field sequential technique of FIG. 4A, MEMS light modulators can be provided which exhibit an analog response to applied voltage. The number of grayscale levels achievable in such a display is limited only by the resolution of digital to analog converters which are supplied in conjunction with data voltage sources.

Alternatively, finer grayscale can be generated if the time period used to display each sub-frame image is split into multiple time periods, each having its own corresponding sub-frame image. For example, with binary light modulators, a display that forms two sub-frame images of equal length and light intensity per color component can generate 27 different colors instead of 8. Gray scale techniques that break each color component of an image frame into multiple sub-frame images are referred to, generally, as time division gray scale techniques.

Figure 4B:
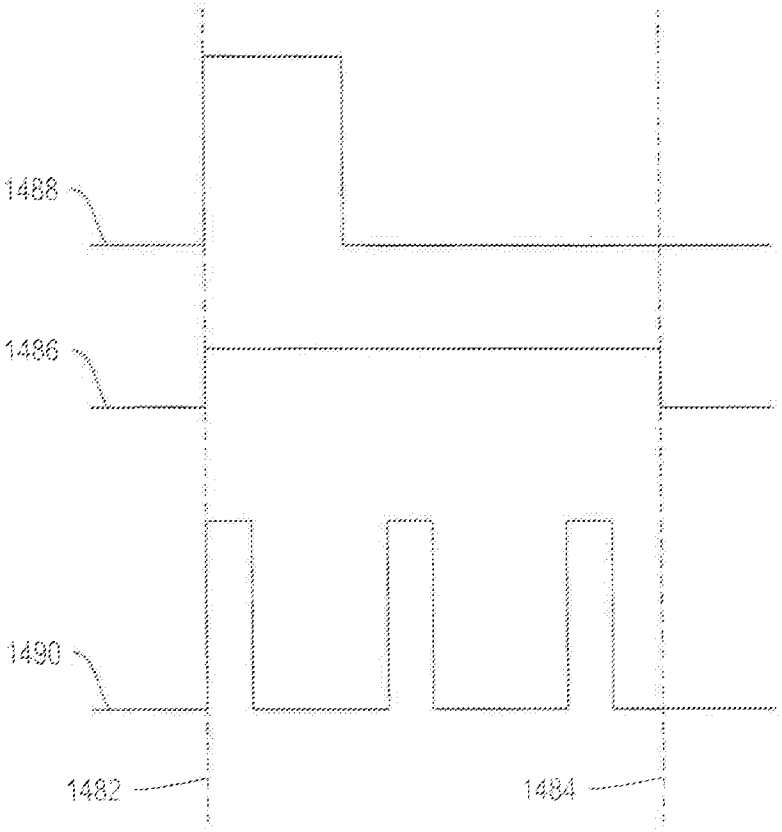
FIG. 4B is a diagram showing alternate pulse profiles for lamps appropriate to this invention.

It is useful to define an illumination value as the product (or the integral) of an illumination period (or pulse width) with the intensity of that illumination. For a given time interval assigned in an output sequence for the illumination of a bitplane there are numerous alternative methods for controlling the lamps to achieve any required illumination value. Three such alternate pulse profiles for lamps appropriate to this invention are compared in FIG. 4B. In FIG. 4B the time markers 1482 and 1484 determine time limits within which a lamp pulse must express its illumination value. In a global actuation scheme for driving MEMS-based displays, the time marker 1482 might represent the end of one global actuation cycle, wherein the modulator states are set for a bitplane previously loaded, while the time marker 1484 can represent the beginning of a subsequent global actuation cycle, for setting the modulator states appropriate to the subsequent bitplane. For bitplanes with smaller significance, the time interval between the markers 1482 and 1484 can be constrained by the time necessary to load data subsets, e.g. bitplanes, into the array of modulators. The available time interval, in these cases, is substantially longer that the time required for illumination of the bitplane, assuming a simple scaling from the pulse widths assigned to bits of larger significance.

The lamp pulse 1486 is a pulse appropriate to the expression of a particular illumination value. The pulse width 1486 completely fills the time available between the markers 1482 and 1484. The intensity or amplitude of lamp pulse 1486 is adjusted, however, to achieve a required illumination value. An amplitude modulation scheme according to lamp pulse 1486 is useful, particularly in cases where lamp efficiencies are not linear and power efficiencies can be improved by reducing the peak intensities required of the lamps.

The lamp pulse 1488 is a pulse appropriate to the expression of the same illumination value as in lamp pulse 1486. The illumination value of pulse 1488 is expressed by means of pulse width modulation instead of by amplitude modulation. For many bitplanes the appropriate pulse width will be less than the time available as determined by the addressing of the bitplanes.

The series of lamp pulses 1490 represent another method of expressing the same illumination value as in lamp pulse 1486. A series of pulses can express an illumination value through control of both the pulse width and the frequency of the pulses. The illumination value can be considered as the product of the pulse amplitude, the available time period between markers 1482 and 1484, and the pulse duty cycle.

Lamp driver circuitry can be programmed to produce any of the above alternate lamp pulses 1486, 1488, or 1490. For example, the lamp driver circuitry can be programmed to accept a coded word for lamp intensity from the timing control module 724 and build a sequence of pulses appropriate to intensity. The intensity can be varied as a function of either pulse amplitude or pulse duty cycle.

Figure 4C:
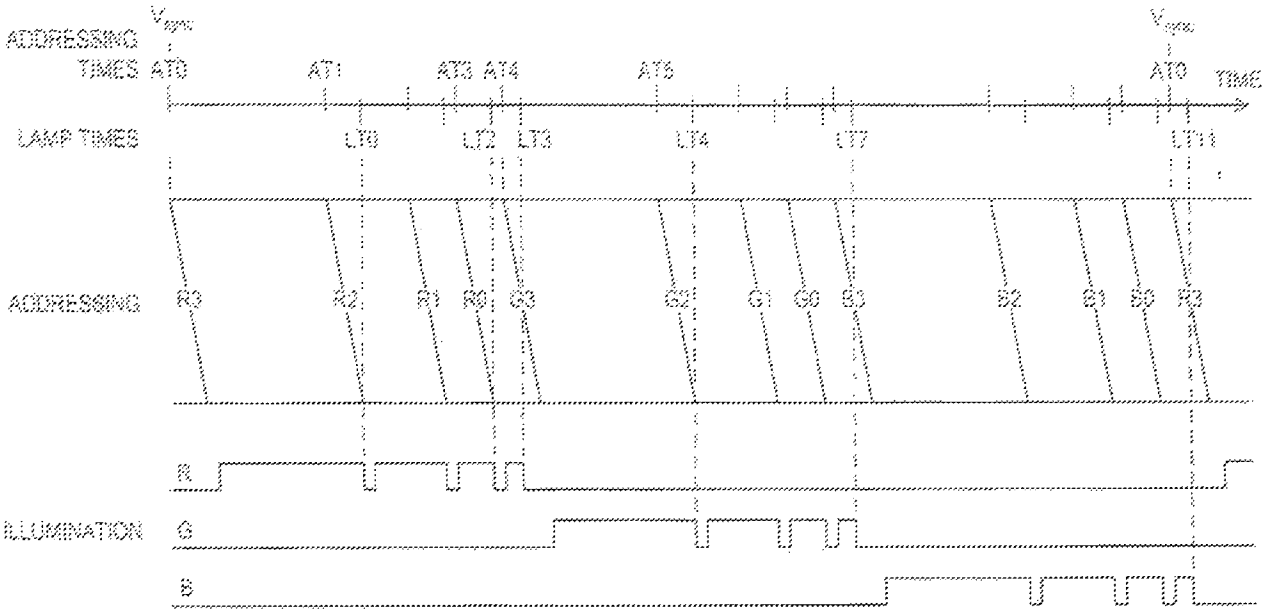
FIG. 4C is a timing sequence employed by the controller for the formation of an image using a series of sub-frame images in a binary time division gray scale according to an illustrative embodiment of the invention.
Figure 4B:
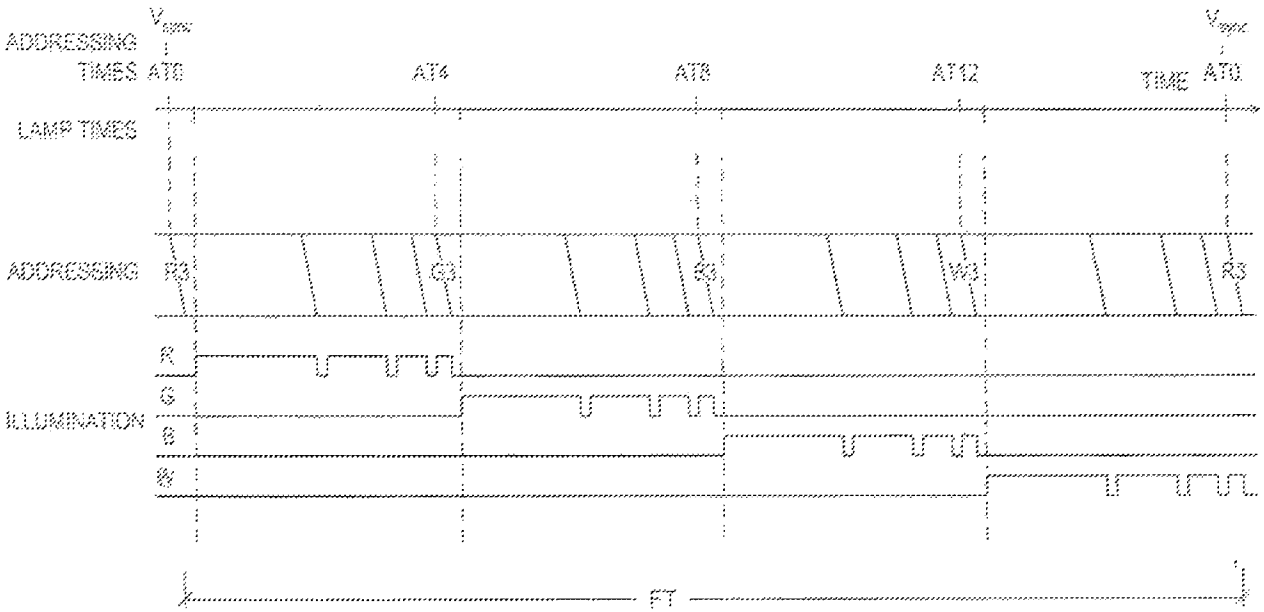

FIG. 4C illustrates an example of a timing sequence, employed by controller 134 for the formation of an image using a series of sub-frame images in a binary time division gray scale. The controller 134 is responsible for coordinating multiple operations in the timed sequence (time varies from left to right in FIG. 4C). The controller 134 determines when data elements of a sub-frame data set are transferred out of the frame buffer and into the data drivers 132. The controller 134 also sends trigger signals to enable the scanning of rows in the array by means of scan drivers 130, thereby enabling the loading of data from the data drivers 132 into the pixels of the array. The controller 134 also governs the operation of the lamp drivers 148 to enable the illumination of the lamps 140, 142, 144. The controller 134 also sends trigger signals to the common drivers 138 which enable functions such as the global actuation of shutters substantially simultaneously in multiple rows and columns of the array.

The process of forming an image in the display process shown in FIG. 4C comprises, for each sub-frame image, first the loading of a sub-frame data set out of the frame buffer and into the array. A sub-frame data set includes information about the desired states of modulators (e.g. open vs closed) in multiple rows and multiple columns of the array. For binary time division gray scale, a separate sub-frame data set is transmitted to the array for each bit level within each color in the binary coded word for gray scale. For the case of binary coding, a sub-frame data set is referred to as a bit plane. (Coded time division schemes using other than binary coding are described in U.S. Patent Application Publication No. US 20015005969 A1) The display process of FIG. 4C refers to the loading of 4 bitplane data sets in each of the three colors red, green, and blue. These data sets are labeled as R0, R1, R2, and R4 for red, G0-G3 for green, and B0-B3 for blue. For economy of illustration only 4 bit levels per color are illustrated in the display process of FIG. 4C, although it will be understood that alternate image forming sequences are possible that employ 6, 7, 8, or 10 bit levels per color.

The display process of FIG. 4C refers to a series of addressing times AT0, AT1, AT2, etc. These times represent the beginning times or trigger times for the loading of particular bitplanes into the array. The first addressing time AT0 coincides with Vsync, which is a trigger signal commonly employed to denote the beginning of an image frame. The display process of FIG. 4C also refers to a series of lamp illumination times LT0, LT1, LT2, etc., which are coordinated with the loading of the bitplanes. These lamp triggers indicate the times at which the illumination from one of the lamps 140, 142, 144 is extinguished. The illumination pulse periods and amplitudes for each of the red, green, and blue lamps are illustrated along the bottom of FIG. 4C, and labeled along separate lines by the letters "R", "G", and "B".

The loading of the first bitplane R3 commences at the trigger point AT0. The second bitplane to be loaded, R2, commences at the trigger point AT1. The loading of each bitplane requires a substantial amount of time. For instance the addressing sequence for bitplane R2 commences in this illustration at AT1 and ends at the point LT0. The addressing or data loading operation for each bitplane is illustrated as a diagonal line in the timing diagram of FIG. 4C. The diagonal line represents a sequential operation in which individual rows of bitplane information are transferred out of the frame buffer, one at a time, into the data drivers 132 and from there into the array. The loading of data into each row or scan line requires anywhere from 1 microsecond to 100 microseconds. The complete transfer of multiple rows or the transfer of a complete bitplane of data into the array can take anywhere from 100 microseconds to 5 milliseconds, depending on the number of rows in the array.

In the display process of FIG. 4C, the process for loading image data to the array is separated in time from the process of moving or actuating the shutters 108. For this implementation, the modulator array includes data memory elements, such as a storage capacitor, for each pixel in the array and the process of data loading involves only the storing of data (i.e. on-off or open-close instructions) in the memory elements. The shutters 108 do not move until a global actuation signal is generated by one of the common drivers 138. The global actuation signal is not sent by the controller 134 until all of the data has been loaded to the array. At the designated time, all of the shutters designated for motion or change of state are caused to move substantially simultaneously by the global actuation signal. A small gap in time is indicated between the end of a bitplane loading sequence and the illumination of a corresponding lamp. This is the time required for global actuation of the shutters. The global actuation time is illustrated, for example, between the trigger points LT2 and AT4. It is preferable that all lamps be extinguished during the global actuation period so as not to confuse the image with illumination of shutters that are only partially closed or open. The amount of time required for global actuation of shutters, such as in shutter assemblies 320, can take, depending on the design and construction of the shutters in the array, anywhere from 10 microseconds to 500 microseconds.

For the example of the display process in FIG. 4C the sequence controller is programmed to illuminate just one of the lamps after the loading of each bitplane, where such illumination is delayed after loading data of the last scan line in the array by an amount of time equal to the global actuation time. Note that loading of data corresponding to a subsequent bitplane can begin and proceed while the lamp remains on, since the loading of data into the memory elements of the array does not immediately affect the position of the shutters.

Each of the sub-frame images, e.g. those associated with bitplanes R3, R2, R1, and R0 is illuminated by a distinct illumination pulse from the red lamp 140, indicated in the "R" line at the bottom of FIG. 4C. Similarly, each of the sub-frame images associated with bitplanes G3, G2, G1, and G0 is illuminated by a distinct illumination pulse from the green lamp 142, indicated by the "G" line at the bottom of FIG. 4C. The illumination values (for this example the length of the illumination periods) used for each sub-frame image are related in magnitude by the binary series 8, 4, 2, 1, respectively. This binary weighting of the illumination values enables the expression or display of a gray scale coded in binary words, where each bitplane contains the pixel on-off data corresponding to just one of the place values in the binary word. The commands that emanate from the sequence controller 160 ensure not only the coordination of the lamps with the loading of data but also the correct relative illumination period associated with each data bitplane.

A complete image frame is produced in the display process of FIG. 4C between the two subsequent trigger signals Vsync. A complete image frame in the display process of FIG. 4C includes the illumination of 4 bitplanes per color. For a 60 Hz frame rate the time between Vsync signals is 16.6 milliseconds. The time allocated for illumination of the most significant bitplanes (R3, G3, and B3) can be in this example approximately 2.4 milliseconds each. By proportion then, the illumination times for the next bitplanes R2, G2, and B2 would be 1.2 milliseconds. The least significant bitplane illumination periods, R0, G0, and B0, would be 300 microseconds each. If greater bit resolution were to be provided, or more bitplanes desired per color, the illumination periods corresponding to the least significant bitplanes would require even shorter periods, substantially less than 100 microseconds each.

It is useful, in the development or programming of the sequence controller 160, to co-locate or store all of the critical sequencing parameters governing expression of gray scale in a sequence table, sometimes referred to as the sequence table store. An example of a table representing the stored critical sequence parameters is listed below as Table 1. The sequence table lists, for each of the sub-frames or "fields" a relative addressing time (e.g. AT0, at which the loading of a bitplane begins), the memory location of associated bitplanes to be found in buffer memory 159 (e.g. location M0, M1, etc.), an identification codes for one of the lamps (e.g. R, G, or B), and a lamp time (e.g. LT0, which in this example determines that time at which the lamp is turned off).

TABLE 1

Sequence Table 1

| | Field 1 | Field 2 | Field 3 | Field 4 | Field 5 | Field 6 | Field 7 | - - - | Field n – 1 | Field n |
|---|---|---|---|---|---|---|---|---|---|---|
| addressing time | AT0 | AT1 | AT2 | AT3 | AT4 | AT5 | AT6 | - - - | AT(n – 1) | ATn |
| memory location of sub-frame data set | M0 | M1 | M2 | M3 | M4 | M4 | M6 | - - - | M(n – 1) | Mn |
| lamp ID | R | R | R | R | G | G | G | - - - | B | B |
| lamp time | LT0 | LT1 | LT2 | LT3 | LT4 | LT5 | LT6 | - - - | LT(n – 1) | LTn |

It is useful to co-locate the storage of parameters in the sequence table to facilitate an easy method for re-programming or altering the timing or sequence of events in a display process. For instance it is possible to re-arrange the order of the color sub-fields so that most of the red sub-fields are immediately followed by a green sub-field, and the green are immediately followed by a blue sub-field. Such rearrangement or interspersing of the color subfields increase the nominal frequency at which the illumination is switched between lamp colors, which reduces the impact of a perceptual imaging artifact known as color break-up. By switching between a number of different schedule tables stored in memory, or by re-programming of schedule tables, it is also possible to switch between processes requiring either a lesser or greater number of bitplanes per color—for instance by allowing the illumination of 8 bitplanes per color within the time of a single image frame. It is also possible to easily re-program the timing sequence to allow the inclusion of sub-fields corresponding to a fourth color LED, such as the white lamp 146.

The display process of FIG. 4C establishes gray scale according to a coded word by associating each sub-frame image with a distinct illumination value based on the pulse width or illumination period in the lamps. Alternate methods are available for expressing illumination value. In one alternative, the illumination periods allocated for each of the sub-frame images are held constant and the amplitude or intensity of the illumination from the lamps is varied between sub-frame images according to the binary ratios 1, 2, 4, 8, etc. For this implementation the format of the sequence table is changed to assign a unique lamp intensity for each of the sub-fields instead of a unique timing signal. In other embodiments of a display process both the variations of pulse duration and pulse amplitude from the lamps are employed and both specified in the sequence table to establish gray scale distinctions between sub-frame images. These and other alternative methods for expressing time domain gray scale using a timing controller are described in US Patent Application Publication No. US 20070205969 A1, published Sep. 6, 2007, incorporated herein by reference.

FIG. 4D is a timing diagram that utilizes the parameters listed in Table 6 (below). The timing diagram of FIG. 4D corresponds to a coded-time division grayscale addressing process in which image frames are displayed by displaying four sub-frame images for each color component of the image frame. Each sub-frame image displayed of a given color is displayed at the same intensity for half as long a time period as the prior sub-frame image, thereby implementing a binary weighting scheme for the sub-frame images. The timing diagram of FIG. 4D includes sub-frame images corresponding to the color white, in addition to the colors red, green and blue, that are illuminated using a white lamp. The addition of a white lamp allows the display to display brighter images or operate its lamps at lower power levels while maintaining the same brightness level. As brightness and power consumption are not linearly related, the lower illumination level operating mode, while providing equivalent image brightness, consumes less energy. In addition, white lamps are often more efficient, i.e. they consume less power than lamps of other colors to achieve the same brightness.

More specifically, the display of an image frame in timing diagram of FIG. 4D begins upon the detection of a vsync pulse. As indicated on the timing diagram and in the Table 6 schedule table, the bitplane R3, stored beginning at memory location M0, is loaded into the array of light modulators 150 in an addressing event that begins at time AT0. Once the controller 134 outputs the last row data of a bitplane to the array of light modulators 150, the controller 134 outputs a global actuation command. After waiting the actuation time, the controller causes the red lamp to be illuminated. Since the actuation time is a constant for all sub-frame images, no corresponding time value needs to be stored in the schedule table store to determine this time. At time AT4, the controller 134 begins loading the first of the green bitplanes, G3, which, according to the schedule table, is stored beginning at memory location M4. At time AT8, the controller 134 begins loading the first of the blue bitplanes, B3, which, according to the schedule table, is stored beginning at memory location M8. At time AT12, the controller 134 begins loading the first of the white bitplanes, W3, which, according to the schedule table, is stored beginning at memory location M12. After completing the addressing corresponding to the first of the white bitplanes, W3, and after waiting the actuation time, the controller causes the white lamp to be illuminated for the first time.

Because all the bitplanes are to be illuminated for a period longer than the time it takes to load a bitplane into the array of light modulators 150, the controller 134 extinguishes the lamp illuminating a sub-frame image upon completion of an addressing event corresponding to the subsequent sub-frame image. For example, LT0 is set to occur at a time after AT0 which coincides with the completion of the loading of bitplane R2. LT1 is set to occur at a time after AT1 which coincides with the completion of the loading of bitplane R1.

The time period between vsync pulses in the timing diagram is indicated by the symbol FT, indicating a frame time. In some implementations the addressing times AT0, AT1, etc. as well as the lamp times LT0, LT1, etc. are designed to accomplish 4 sub-frame images for each of the 4 colors within a frame time FT of 16.6 milliseconds, i.e. according to a frame rate of 60 Hz. In other implementations the time values stored in the schedule table store can be altered to accomplish 4 sub-frame images per color within a frame time FT of 33.3 milliseconds, i.e. according to a frame rate of 30 Hz. In other implementations frame rates as low as 24 Hz may be employed or frame rates in excess of 100 Hz may be employed.

TABLE 6

Schedule Table 6

| | Field 1 | Field 2 | Field 3 | Field 4 | Field 5 | Field 6 | Field 7 | - - - | Field n – 1 | Field n |
|---|---|---|---|---|---|---|---|---|---|---|
| addressing time | AT0 | AT1 | AT2 | AT3 | AT4 | AT5 | AT6 | - - - | AT(n – 1) | ATn |
| memory location of sub-frame data set | M0 | M1 | M2 | M3 | M4 | M4 | M6 | - - - | M(n – 1) | Mn |
| lamp ID | R | R | R | R | G | G | G | - - - | W | W |

The use of white lamps can improve the efficiency of the display. The use of four distinct colors in the sub-frame images requires changes to the data processing in the input processing module. Instead of deriving bitplanes for each of 3 different colors, a display process according to timing diagram of FIG. 4D requires bitplanes to be stored corresponding to each of 4 different colors. The input processing module may therefore convert the incoming pixel data, encoded for colors in a 3-color space, into color coordinates appropriate to a 4-color space before converting the data structure into bitplanes.

In addition to the red, green, blue, and white lamp combination, shown in the timing diagram of FIG. 4D, other lamp combinations are possible which expand the space or gamut of achievable colors. A useful 4-color lamp combination with expanded color gamut is red, blue, true green (about 520 nm) plus parrot green (about 550 nm). Another 5-color combination which expands the color gamut is red, green, blue, cyan, and yellow. A 5-color analogue to the well known YIQ color space can be established with the lamps white, orange, blue, purple, and green. A 5-color analog to the well known YUV color space can be established with the lamps white, blue, yellow, red, and cyan.

Other lamp combinations are possible. For instance, a useful 6-color space can be established with the lamp colors red, green, blue, cyan, magenta, and yellow. A 6-color space can also be established with the colors white, cyan, magenta, yellow, orange, and green. A large number of other 4-color and 5-color combinations can be derived from amongst the colors already listed above. Further combinations of 6, 7, 8 or 9 lamps with different colors can be produced from the colors listed above, Additional colors may be employed using lamps with spectra which lie in between the colors listed above.

Figure 4E:
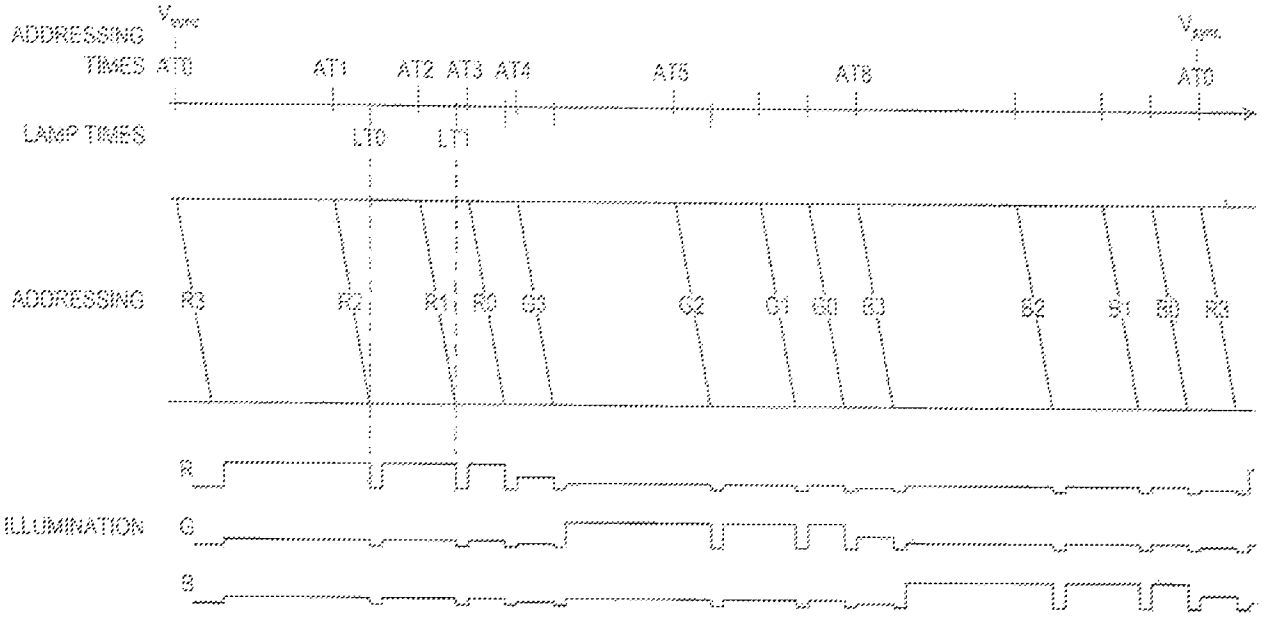
FIG. 4E is a timing diagram that corresponds to a hybrid coded-time division and intensity grayscale display process in which lamps of different colors may be illuminated simultaneously according to an illustrative embodiment of the invention.

FIG. 4E is a timing diagram that utilizes the parameters listed in the schedule table of Table 7. The timing diagram of FIG. 4E corresponds to a hybrid coded-time division and intensity grayscale display process in which lamps of different colors may be illuminated simultaneously. Though each sub-frame image is illuminated by lamps of all colors, sub-frame images for a specific color are illuminated predominantly by the lamp of that color. For example, during illumination periods for red sub-frame images, the red lamp is illuminated at a higher intensity than the green lamp and the blue lamp. As brightness and power consumption are not linearly related, using multiple lamps each at a lower illumination level operating mode may require less power than achieving that same brightness using one lamp at an higher illumination level.

The sub-frame images corresponding to the least significant bitplanes are each illuminated for the same length of time as the prior sub-frame image, but at half the intensity. As such, the sub-frame images corresponding to the least significant bitplanes are illuminated for a period of time equal to or longer than that required to load a bitplane into the array.

Table 7 schedule table, the bitplane R3, stored beginning at memory location M0, is loaded into the array of light modulators 150 in an addressing event that begins at time AT0. Once the controller 134 outputs the last row data of a bitplane to the array of light modulators 150, the controller 134 outputs a global actuation command. After waiting the actuation time, the controller causes the red, green and blue lamps to be illuminated at the intensity levels indicated by the Table 7 schedule, namely RI0, GI0 and BI0, respectively. Since the actuation time is a constant for all sub-frame images, no corresponding time value needs to be stored in the schedule table store to determine this time. At time AT1, the controller 134 begins loading the subsequent bitplane R2, which, according to the schedule table, is stored beginning at memory location M1, into the array of light modulators 150. The sub-frame image corresponding to bitplane R2, and later the one corresponding to bitplane R1, are each illuminated at the same set of intensity levels as for bitplane R1, as indicated by the Table 7 schedule. In comparison, the sub-frame image corresponding to the least significant bitplane R0, stored beginning at memory location M3, is illuminated at half the intensity level for each lamp. That is, intensity levels RI3, GI3 and BI3 are equal to half that of intensity levels RI0, GI0 and BI0, respectively. The process continues starting at time AT4, at which time bitplanes in which the green intensity predominates are displayed. Then, at time AT8, the controller 134 begins loading bitplanes in which the blue intensity dominates.

Because all the bitplanes are to be illuminated for a period longer than the time it takes to load a bitplane into the array of light modulators 150, the controller 134 extinguishes the lamp illuminating a sub-frame image upon completion of an addressing event corresponding to the subsequent sub-frame image. For example, LT0 is set to occur at a time after AT0 which coincides with the completion of the loading of bitplane R2. LT1 is set to occur at a time after AT1 which coincides with the completion of the loading of bitplane R1.

The mixing of color lamps within sub-frame images in the timing diagram of FIG. 4E can lead to improvements in power efficiency in the display. Color mixing can be particularly useful when images do not include highly saturated colors.

Display Panels

Figure 5:
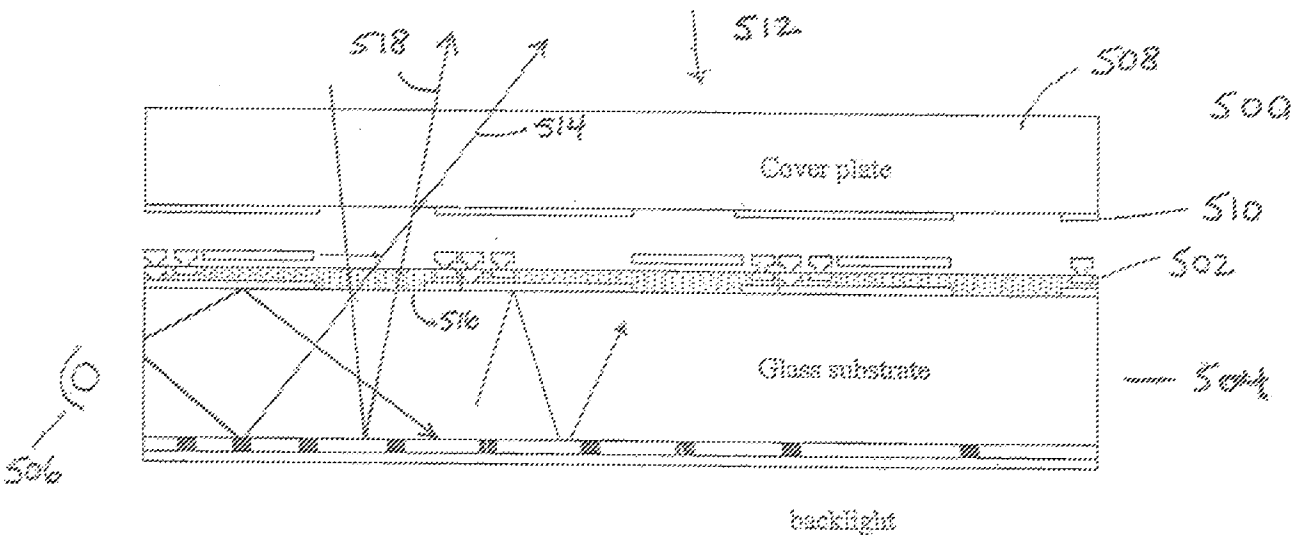
FIG. 5 is a cross sectional view of a shutter-based spatial light modulator, according to an illustrative embodiment of the invention.

FIG. 5 is a cross sectional view of a shutter-based spatial light modulator 500, according to the illustrative embodiment of the invention. The shutter-based spatial light modulator 500 includes a light modulation array 502, an optical cavity

TABLE 7

Schedule Table 7

| | Field 1 | Field 2 | Field 3 | Field 4 | Field 5 | Field 6 | Field 7 | - - - | Field n – 1 | Field n |
|---|---|---|---|---|---|---|---|---|---|---|
| data time | AT0 | AT1 | AT2 | AT3 | AT4 | AT5 | AT6 | - - - | AT(n – 1) | ATn |
| memory location of sub-frame data set | M0 | M1 | M2 | M3 | M4 | M5 | M6 | - - - | M(n – 1) | Mn |
| red average intensity | RI0 | RI1 | RI2 | RI3 | RI4 | RI5 | RI6 | - - - | RI(n – 1) | Rn |
| green average intensity | GI0 | GI1 | GI2 | GI3 | GI4 | GI5 | GI6 | - - - | GI(n – 1) | Gn |
| blue average intensity | BI0 | BI1 | BI2 | BI3 | BI4 | BI5 | BI6 | - - - | BI(n – 1) | Bn |

More specifically, the display of an image frame in the timing diagram of FIG. 4E begins upon the detection of a vsync pulse. As indicated on the timing diagram and in the 504, and a light source 506. In addition, the spatial light modulator includes a cover plate 508. As shown in FIG. 5, a light ray 514 may originate from the light source 506 before being modulated and emitted to a viewer. Also, a light ray 518 may originate from the ambient before being modulated and emitted to a viewer.

The cover plate 508 serves several functions, including protecting the light modulation array 502 from mechanical and environmental damage. The cover plate 508 may be constructed from a thin transparent plastic, such as polycarbonate, or a glass sheet. The cover plate can be coated and patterned with a light absorbing material, also referred to as a black matrix 510. The black matrix can be deposited onto the cover plate as a thick film acrylic or vinyl resin that contains light absorbing pigments. Optionally, a separate layer may be provided.

The black matrix 510 absorbs substantially some or all incident ambient light 512. In certain embodiment (i.e., in reflective and transflective modes), ambient light that passes through the black matrix enters the light cavity and is recycled back out to a user. Ambient light is light that originates from outside the spatial light modulator 500, from the vicinity of the viewer. As shown in FIG. 5, light may originate from light source 506 and be modulated by modulation array 502 before reaching a viewer. In certain embodiments, light may originate from the ambient, be recycled in the spatial light modulator 500 and be modulated by modulation array 502 before reaching a viewer. The ambient light may be recycled to any pixel in the display. In certain embodiments, the black matrix 510 may increases the contrast of an image formed by the spatial light modulator 500. The black matrix 510 can also function to absorb light escaping the optical cavity 504 that may be emitted, in a leaky or time-continuous fashion.

In one implementation, color filters, for example, in the form of acrylic or vinyl resins are deposited on the cover plate 508. The filters may be deposited in a fashion similar to that used to form the black matrix 510, but instead, the filters are patterned over the open apertures light transmissive regions 516 of the optical cavity 504. The resins can be doped alternately with red, green, blue or other pigments.

The spacing between the light modulation array 502 and the cover plate 508 is less than 100 microns, and may be as little as 10 microns or less. The light modulation array 502 and the cover plate 508 preferably do not touch, except, in some cases, at predetermined points, as this may interfere with the operation of the light modulation array 502. The spacing can be maintained by means of lithographically defined spacers or posts, 2 to 20 microns tall, which are placed in between the individual right modulators in the light modulators array 502, or the spacing can be maintained by a sheet metal spacer inserted around the edges of the combined device.

Figure 6A:
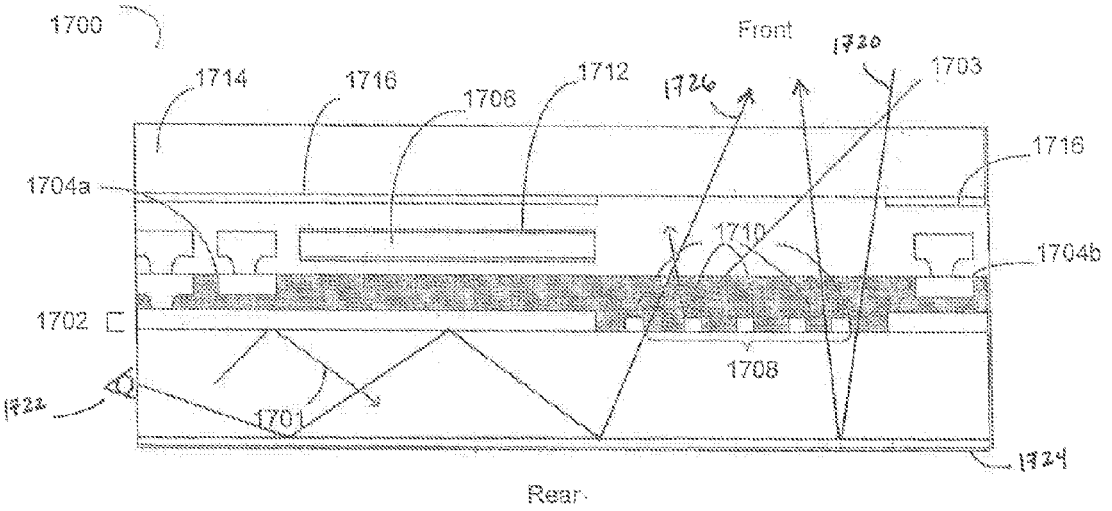
FIG. 6A is a cross sectional view of a shutter-based spatial light modulator, according to an illustrative embodiment of the invention.

FIG. 6A is a cross-sectional view of a shutter assembly 1700, according to an illustrative embodiment of the invention. The shutter assembly 1700 forms images from both light 1701 emitted by a light source positioned behind the shutter assembly 1700 and from ambient light 1703. The shutter assembly 1700 includes a metal column layer 1702, two row electrodes 1704*a* and 1704*b*, light source 1722, bottom reflective layer 1724 and a shutter 1706. The shutter assembly 1700 includes an aperture 1708 etched through the column metal layer 1702. Portions of the column metal layer 1702, having dimensions of from about 1 to about 5 microns, are left on the surface of the aperture 1708 to serve as transflection elements 1710. A light absorbing film 1712 covers the top surface of the shutter 1706.

While the shutter is in the closed position, the light absorbing film 1712 absorbs ambient light 1703 impinging on the top surface of the shutter 1706. While the shutter 1706 is in the open position as depicted in FIG. 17, the shutter assembly 1700 contributes to the formation of an image both by allowing light 1701 to pass through the shutter assembly originating from the dedicated light source 1722 and from reflected ambient light 1703 and 1720. The small size of the transflective elements 1710 results in a somewhat random pattern of ambient light 1703 reflection. In certain embodiments, the ambient light 1720 may be reflected off of bottom reflective layer 1724 and recycled in the light cavity before being emitted back out to a user.

The shutter assembly 1700 is covered with a cover plate 1714, which includes a black matrix 1716. The black matrix absorbs light, thereby substantially preventing ambient light 1703 from reflecting back to a viewer unless the ambient light 1703 reflects off of an uncovered aperture 1708 or reflective layer 1724.

Figure 6B:
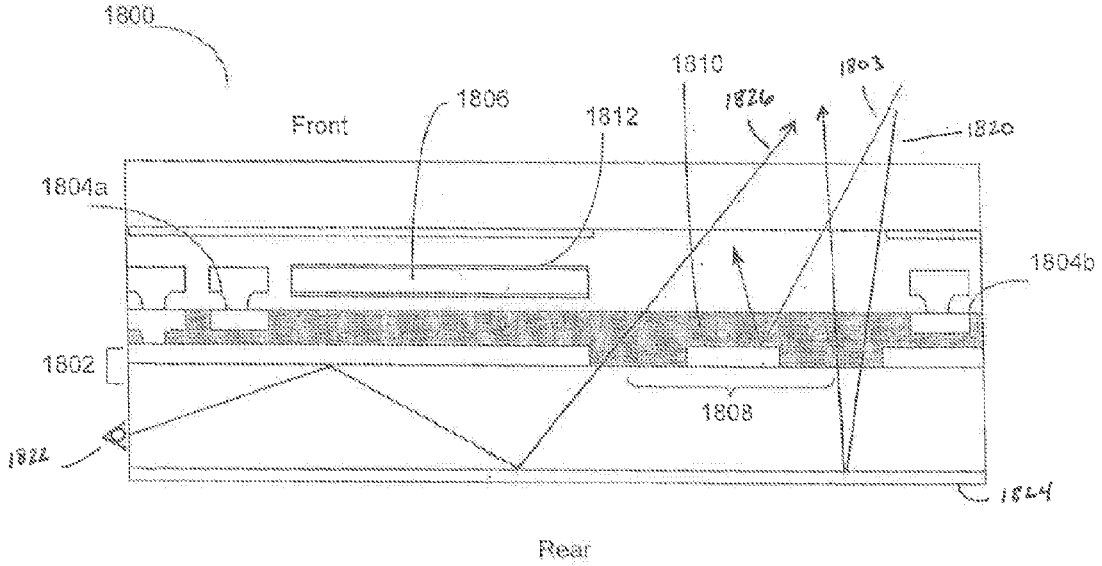
FIG. 6B is a cross sectional view of a shutter-based spatial light modulator, according to an illustrative embodiment of the invention.

FIG. 6B is a cross-sectional view of an example of another shutter assembly 1800 according to an illustrative embodiment of the invention. The shutter assembly 1800 includes a metal column layer 1802, two row electrodes 1804*a* and 1804*b*, light source 1822, bottom reflective layer 1824, and a shutter 1806. The shutter assembly 1800 includes an aperture 1808 etched through the column metal layer 1802. At least one portion of the column metal layer 1802, having dimensions of from about 5 to about 20 microns, remains on the surface of the aperture 1808 to serve as a transflection element 1810. A light absorbing film 1812 covers the top surface of the shutter 1806. While the shutter is in the closed position, the light absorbing film 1812 absorbs ambient light 1803 impinging on the top surface of the shutter 1806. While the shutter 1806 is in the open position, the transflective element 1810 reflects a portion of ambient light 1803 striking the aperture 1808 back towards a viewer. In certain embodiments, bottom layer 1824 reflects at least a portion of ambient light 1820 back toward a viewer. The larger dimensions of the transflective element 1810 in comparison to the transflective elements 1710 yield a more specular mode of reflection, such that ambient light originating from behind the viewer is substantially reflected directly back to the viewer.

The shutter assembly 1800 is covered with a cover plate 1814, which includes a black matrix 1816. The black matrix absorbs light, thereby substantially preventing ambient light 1803 from reflecting back to a viewer unless the ambient light 1803 reflects off of an uncovered aperture 1808.

Referring to both FIGS. 6A and 6B, even with the transflective elements 1710 and 1810 positioned in the apertures 1708 and 1808, some portion of the ambient light 1703 and 1803 passes through the apertures 1708 and 1808 of the corresponding shutter assemblies 1700 and 1800. When the shutter assemblies 1700 and 1800 are incorporated into spatial light modulators having optical cavities and light sources, as described above, the ambient light 1703 and 1803 passing through the apertures 1708 and 1808 enters the optical cavity and is recycled along with the light introduced by the light source. In some embodiments, the optical cavity is a reflective optical cavity. In alternative shutter assemblies, the apertures in the column metal are at least partially filled with a semi-reflective—semitransmissive material.

Figure 6C:
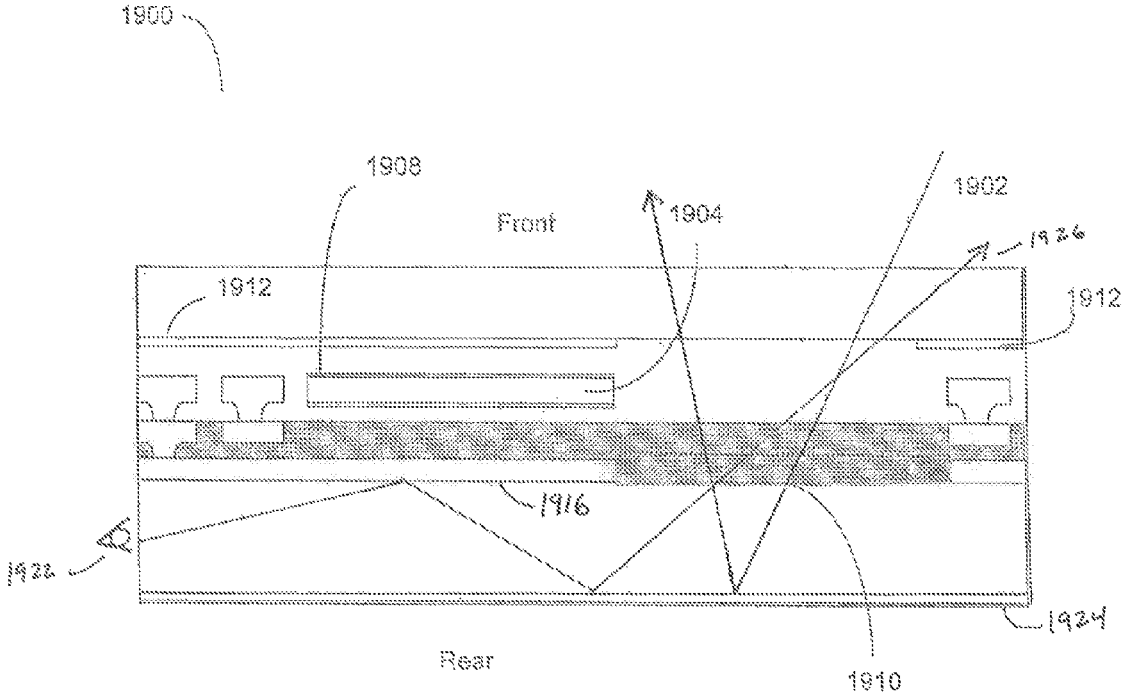
FIG. 6C is a cross sectional view of a shutter-based spatial light modulator, according to an illustrative embodiment of the invention.

FIG. 6C is a cross sectional view of a shutter assembly 1900 according to an illustrative embodiment of the invention. The shutter assembly 1900 can be used in a reflective light modulation array. The shutter assembly 1900 reflects ambient light 1902 from rear reflective layer 1924 towards a viewer. In certain embodiments, the light 1902 may be recycled in the optical cavity before being emitted to a viewer. Thus, use of arrays of the shutter assembly 1900 in spatial light modulators allow the controller to keep the light source 1922 un-illuminated while in a reflective mode. The shutter assembly 1900 includes a rear-facing reflective layer 1916.

The front-most layer of the shutter assembly 1900, including at least the front surface of the shutter 1904, is coated in a light absorbing film 1908. Thus, when the shutter 1904 is closed, light 1902 impinging on the shutter assembly 1900 is absorbed. When the shutter 1904 is open, at least a fraction of the light 1902 impinging on the reflective shutter assembly 1900 reflects off the exposed reflective layer 1924 back towards a viewer. Alternately the rear reflective layer 1924 can be covered with an absorbing film while the front surface of shutter 1908 can be covered in a reflective film. In this fashion light is reflected back to the viewer only when the shutter is closed.

As with the other shutter assemblies and light modulators described above, the shutter assembly 1900 can be covered with a cover plate 1910 having a black matrix 1912 applied thereto. The black matrix 1912 covers portions of the cover plate 1910 not opposing the open position of the shutter.

Each of the shutter assemblies in FIGS. 6A-6C may be operated in a transmissive, reflective or transflective mode. In addition, a display apparatus including the shutter assemblies depicted in FIGS. 6A-6C, if it includes an appropriate controller as described herein, may transition between operating in one or more transflective modes, transmissive modes, and reflective modes by, among other things, adjusting the intensity of the internal light source, including, in reflective modes, by keeping the internal light source off or unilluminated during light modulation Additionally, the examples of light modulators described with respect to FIGS. 6A-6C can be built with a separate light guide behind the substrate on which the light modulators are built, or they can be built in a MEMS down configuration where the light modulators are coupled to the cover plate (e.g., see FIG. 7 for MEMS down configuration).

In each of the examples of shutter assemblies shown in FIGS. 6A-6C, as well as FIG. 7 (described below), the same light modulator modulates both light originating from the ambient as light from the internal light source. Therefore, the same data interconnects may be used to control modulation of both light originating from the ambient and light generated by the internal light source.

The shutter assemblies 1700, 1800, and 1900, which include optical cavities for the recycling of light, provide high contrast images formed from reflected light. In some embodiments a low-power reflective display can be provided by eliminated the light sources 1722, 1822, and 1922 altogether from the display assembly.

Figure 7:
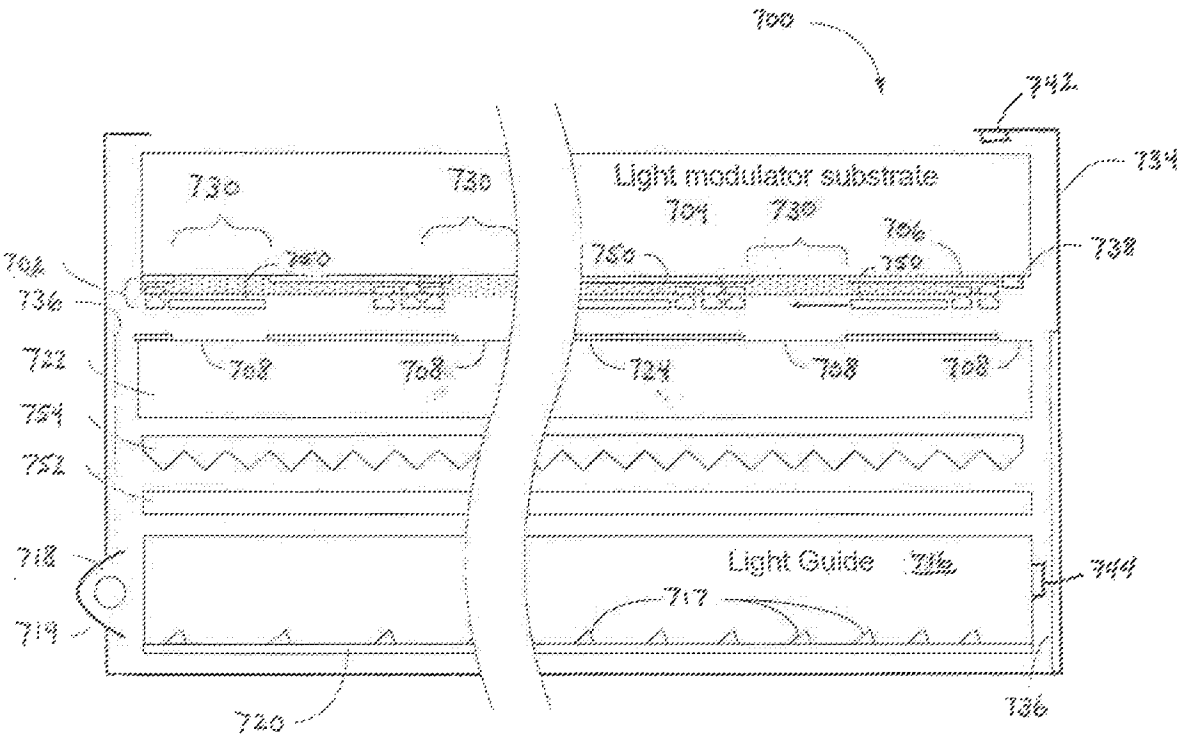
FIG. 7 is a is a cross sectional view of a shutter-based spatial light modulator including a light detector, according to an illustrative embodiment of the invention.

FIG. 7 is cross sectional view of a display assembly 700 including a photosensor, according to illustrative embodiments of the invention. The display assembly 700 features a light guide 716, a reflective aperture layer 724, and a set of shutter assemblies 702, all of which are built onto separate substrates. In FIG. 7, the shutter assemblies 702 are positioned such that they are faced directly opposite to the reflective aperture layer 724.

In FIG. 7, three examples of photosensor positioning are shown. Photosensor 738 is built onto substrate 704 facing directly opposite to the reflective aperture layer 724. Photosensor 742 is attached to the assembly bracket 734 (In an alternate embodiment, a photosensor can be placed on the front face of substrate 704, i.e. the side that faces the viewer.) The photosensor 742 can be positioned on the assembly bracket either at a position close to the light guide 716 or it can be positioned on the assembly bracket 734 near the front of the display. The photosensor 742 can be placed on an outside surface of the assembly bracket 734, in which case it receives a strong signal from the ambient but perhaps zero signal from the lamps 718. In certain embodiments, the photosensor 742 is positioned such that it can receive light both from the ambient and from the lamps 718. The photosensor 744 is attached to the light guide 716. In this position the photosensor 744 receives a strong signal from lamps 718, and yet can still indirectly measure light from the ambient. The photosensor 744 can be molded directly within the plastic material of the light guide 716. Ambient light can reach the light guide 716 after passing through shutter assemblies 702 which are in the open position and through the apertures 708 in the reflective aperture layer 724. The ambient light can then be distributed throughout the light guide so as to impinge on photosensor 744 after scattering off of scattering centers 717 and/or the front-facing reflective layer 720. Although the signal strength for ambient light will be reduced for a photosensor attached to the light guide 716, such a sensor can still be effective at measuring changes to light intensity from the ambient, such as the difference between indoor and outdoor, or between daytime and nighttime lighting levels.

The photosensor 738 in FIG. 7 is built directly onto the light modulator substrate 704, on the side of the substrate 704 that faces directly opposite to the reflective aperture layer 724. (In an alternate embodiment, a photosensor can be placed on the front face of substrate 704, i.e. the side that faces the viewer.) The photosensor 738 may be a discrete component that is soldered in place on substrate 704. The photosensor 738 may employ thin film interconnects which are deposited and patterned on the substrate 704, or it may comprise its own wiring harness. If mounted as a discrete component, the photosensor 738 can be packaged such that light can enter the active region of the sensor from two directions: i.e. either from light that originates from the light guide 716 or from the ambient, i.e. from the direction of the viewer. Alternately, the photosensor 738 can be formed from thin film components which are formed at the same time on substrate 704, using similar processes as used with the shutter assemblies 702. In one implementation, the photosensor 738 can be formed from a structure similar to that used for thin film transistors employed in an active matrix control matrix formed on the light modulator substrate 704, i.e. it can be formed from either amorphous or polycrystalline silicon. Suitable photosensors utilizing thin films, such as amorphous silicon, are known in the art, for example, for use in wide-area x-ray imagers.

The photosensors 738, 742, and 744 can be broad-band photosensors, meaning they are sensitive to all light in the visible spectrum, or they can be narrowband. A narrowband sensor can be created, for instance, by placing a color filter in front of the photosensor such that its sensitivity is peaked at only a few wavelengths in the spectrum, for instance at red, or green, or blue wavelengths. In one implementation, photosensors 738, 742, or 744 can represent a group of three or more photosensors, each sensor being a narrowband sensor tuned to a wavelength appropriate to the spectrum of one of the lamps 718. Another narrowband sensor can be provided within the group of sensors 738, or 742, or 744 in which the sensitive band is chosen to correspond to a wavelength which is indicative of the general ambient illumination and relatively insensitive to the wavelengths from any of the lamps 718, for instance it could be sensitive to primarily yellow radiation near 570 nm. In a preferred implementation, described below, only a single broad-band sensor is employed, and timing signals from the field sequential display are employed to help the sensor discriminate between light that originates from the various lamps 718 or from the ambient.

The shutter assemblies 702 in FIG. 7 include shutters 750 that move horizontally in the plane of the substrate. In other embodiments, the shutters can rotate or move in a plane transverse to the substrate. In other embodiments, a pair of fluids can be disposed in the same position as shutter assemblies 702 where they can function as electrowetting modulators. In other embodiments, a series of light taps which provide a mechanism for controlled frustrated total internal reflection can be utilized in place of shutter assemblies 702.

The vertical distance between the shutter assemblies 702 and the reflective aperture layer 724 is less than about 0.5 mm. In an alternative embodiment the distance between the shutter assemblies 702 and the reflective aperture layer 724 is greater than 0.5 mm, but is still smaller than the display pitch. The display pitch is defined as the distance between pixels (measured center to center), and in many cases is established as the distance between apertures 708 in the rear-facing reflective layer 724. When the distance between the shutter assemblies 702 and the reflective aperture layer 724 is less than the display pitch a larger fraction of the light that passes through the apertures 708 will be intercepted by their corresponding shutter assemblies 702 and the one or more photosensors 738, 742, 744.

Display assembly 700 includes a light guide 716, which is illuminated by one or more lamps 718. The lamps 718 can be, for example, and without limitation, incandescent lamps, fluorescent lamps, lasers, or light emitting diodes (LEDs). In one embodiment, the lamps 718 include LEDs of various colors (e.g., a red LED, a green LED, and a blue LED), which may be alternately illuminated to implement field sequential color.

In addition to red, green, and blue, several 4-color combinations of colored lamps 518 are possible, for instance the combination of red, green, blue, and white or the combination of red, green, blue, and yellow. Some lamp combinations are chosen to expand the space or gamut of reproducible colors. A useful 4-color lamp combination with expanded color gamut is red, blue, true green (about 520 nm), and parrot green (about 550 nm). One 5-color combination which expands the color gamut is red, green, blue, cyan, and yellow. A 5-color lamp combination analogue to the well-known YIQ color space can be established with the lamp colors white, orange, blue, purple, and green. A 5-color lamp combination analogue to the well-known YUV color space can be established with the lamp colors white, blue, yellow, red, and cyan. Other lamp combinations are possible. For instance, a useful 6-color space can be established with the lamp colors red, green, blue, cyan, magenta, and yellow. An alternate combination is white, cyan, magenta, yellow, orange, and green. Combinations of up to 8 or more different colored lamps may be used using the colors listed above, or employing alternate colors whose spectra lie in between the colors listed above.

The lamp assembly includes a light reflector or collimator 719 for introducing a cone of light from the lamp into the light guide within a predetermined range of angles. The light guide includes a set of geometrical extraction structures or deflectors 717 which serve to re-direct light out of the light guide and along the vertical or z-axis of the display. The density of deflectors 717 varies with distance from the lamp 718.

The display assembly 700 includes a front-facing reflective layer 720, which is positioned behind the light guide 716. In display assembly 700, the front-facing reflective layer 720 is deposited directly onto the back surface of the light guide 716. In other implementations the back reflective layer 720 is separated from the light guide by an air gap. The back reflective layer 720 is oriented in a plane substantially parallel to that of the reflective aperture layer 724.

Interposed between the light guide 716 and the shutter assemblies 702 is an aperture plate 722. Disposed on the top surface of the aperture plate 722 is the reflective aperture or rear-facing reflective layer 724. The reflective layer 724 defines a plurality of surface apertures 708, each one located directly beneath the closed position of one of the shutters 750 of shutter assemblies 702.

An optical cavity is formed by the reflection of light between the rear-facing reflective layer 724 and the front-facing reflective layer 720. Light originating from the lamps 718 may escape from the optical cavity through the apertures 708 to the shutter assemblies 702, which are controlled to selectively block the light using shutters 750 to form images. Light that does not escape through an aperture 708 is returned by reflective layer 724 to the light guide 716 for recycling. A similar reflective optical cavity is formed between the reflective layers 1702 and 1724 in shutter assembly 1700. A similar optical cavity is formed between the reflective layers 1802 and 1824 in shutter assembly 1800. A similar optical cavity is formed between the reflective layers 1916 and 1924 in shutter assembly 1900. An optical cavity similar to that formed between reflective layers 720 and 724 can also be employed for use with optical cavity 504.

Interposed between the light guide 716 and the shutter assemblies 702 is an optical diffuser film 732 and a prism film 754. Both of these films help to randomize the direction of light, including ambient light, which is recycled within the optical cavity before it is emitted through one of the apertures 708. The prism film 754 is an example of a rear-facing prism film. In alternate embodiments a front-facing prism film may be employed for this purpose, or a combination of rear-facing and front-facing prism films. Prism films useful for the purpose of film 754 are sometimes referred to as brightness enhancing films or as optical turning films.

Light that passes through apertures 708 may also strike the one or more photosensors 738, 742, 744, which measures the brightness or intensity of the light for the purposes of maintaining image and color quality. The photosensors 738, 742, 744 may also be disposed to detect ambient light which reaches it through the light modulator substrate 704 for the purposes of adapting lamp illumination levels and/or shutter modulation. In some embodiments, brighter ambient light requires brighter images to be displayed by the display apparatus 700, and therefore requires greater drive currents or voltages to be applied to the lamps 718. In some embodiments, the ambient light may be modulated in a reflective or transflective mode to contribute to the brightness of an image. In this case, the drive currents and voltages applied to the lamps 718 may be reduced to save power.

The aperture plate 722 can be formed, for example, from glass or plastic. To form the rear-facing reflective layer 724, a metal layer or thin film can be deposited onto the aperture plate 722. Suitable highly reflective metal layers include fine-grained metal films without or with limited inclusions formed by a number of vapor deposition techniques including sputtering, evaporation, ion plating, laser ablation, or chemical vapor deposition. Metals that are effective for this reflective application include, without limitation, Al, Cr, Au, Ag, Cu, Ni, Ta, Ti, Nd, Nb, Si, Mo and/or alloys thereof. After deposition, the metal layer can be patterned by any of a number of photolithography and etching techniques known in the microfabrication art to define the array of apertures 708.

In another implementation, the rear-facing reflective layer 724 can be formed from a mirror, such as a dielectric mirror. A dielectric mirror is fabricated as a stack of dielectric thin films which alternate between materials of high and low refractive index. A portion of the incident light is reflected from each interface where the refractive index changes. By controlling the thickness of the dielectric layers to some fixed fraction or multiple of the wavelength and by adding reflections from multiple parallel dielectric interfaces (in some cases more than 6), it is possible to produce a net reflective surface having a reflectivity exceeding 98%. Hybrid reflectors can also be employed, which include one or more dielectric layers in combination a metal reflective layer.

The techniques described above for the formation of reflective layer 724 can also be applied to the formation of reflective layers 286, 1702, 1802, or 1916.

The substrate 704 forms the front of the display assembly 700. A low reflectivity film 706, disposed on the substrate 704, defines a plurality of surface apertures 730 located between the shutter assemblies 702 and the substrate 704. The materials chosen for the film 706 are designed to minimize reflections of ambient light and therefore increase the contrast of the display. In some embodiments the film 706 is comprised of low reflectivity metals such as W or W—Ti alloys. In other embodiments the film 706 is made of light absorptive materials or a dielectric film stack which is designed to reflect less than 20% of the incident light. Further low reflectivity films and or sequences of thin films are described in U.S. patent application Ser. No. 12/985,196, which is incorporated herein by reference.

Additional optical films can be placed on the outer surface of substrate 704, i.e. on the surface closest to the viewer. For instance the inclusion of circular polarizers or thin film notch filters (which allow the passage of light in the wavelengths of the lamps 718) on this outer surface can further decrease the reflectance of ambient light without otherwise degrading the luminance of the display.

A sheet metal or molded plastic assembly bracket 734 holds the aperture plate 722, shutter assemblies 702, the substrate 704, the light guide 716 and the other component parts together around the edges. The assembly bracket 732 is fastened with screws or indent tabs to add rigidity to the combined display assembly 700. In some implementations, the light source 718 is molded in place by an epoxy potting compound.

The assembly bracket includes side-facing reflective films 736 positioned close to the edges or sides of the light guide 716 and aperture plate 722. These reflective films reduce light leakage in the optical cavity by returning any light that is emitted out the sides of either the light guide or the aperture plate back into the optical cavity. The distance between the sides of the light guide and the side-facing reflective films is preferably less than about 0.5 mm, more preferably less than about 0.1 mm.

Information from sensors, such as a thermal sensor or photosensor (e.g., the photosensors 738, 742, and 744), are transmitted to a controller for controlling the illumination of the lamps and/or shutter modulation, thereby implementing either a closed-loop feedback or open-loop control to maintain image quality (e.g., by varying the brightness of the images displayed or altering the balance of colors to improve color quality).

With respect to FIG. 7, in addition to the example of the display assembly shown, in certain embodiments the transflective elements described with respect to FIGS. 6A and 6B can be added to the aperture in FIG. 7 to increase transflectance.

Display Modes

Figure 8:
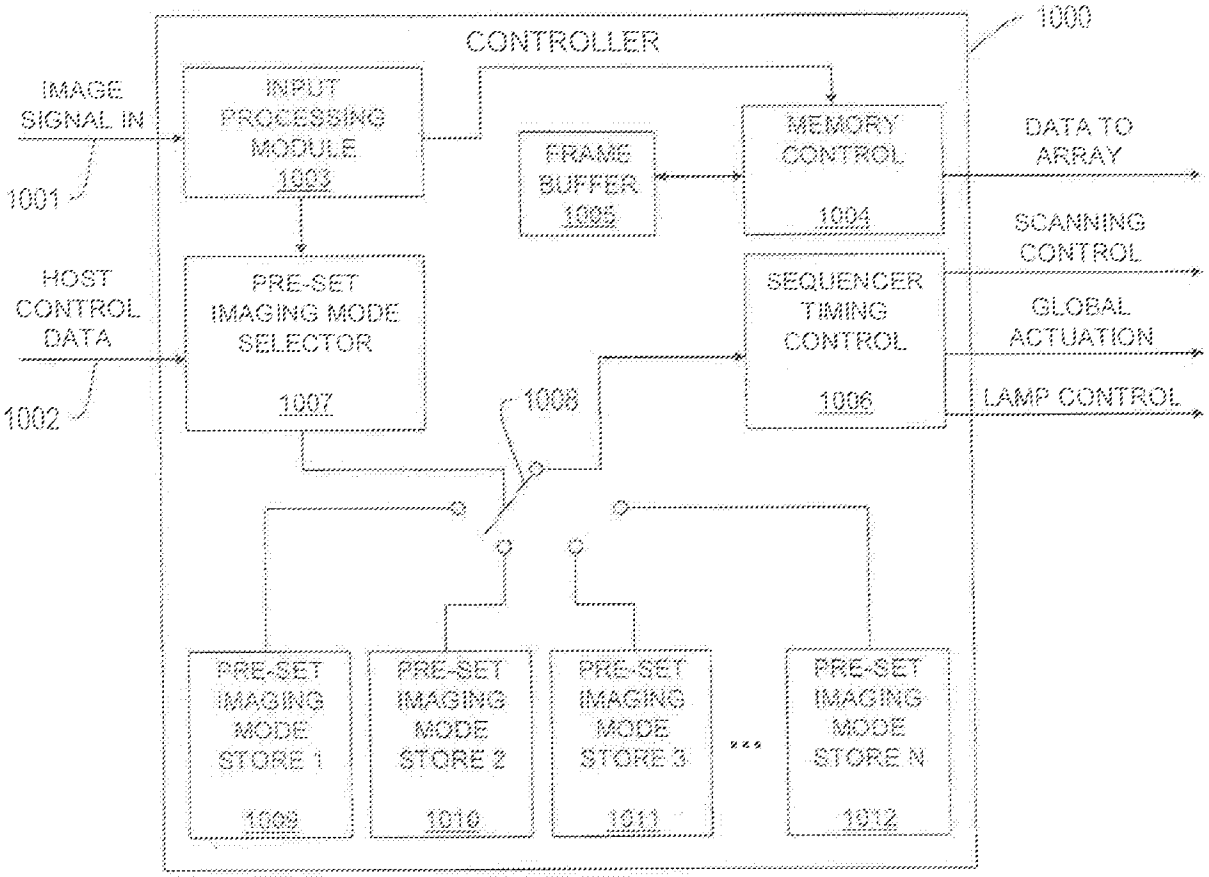
FIG. 8 is a block diagram of a controller for use in a direct-view display, according to an illustrative embodiment of the invention.

FIG. 8 is a block diagram of a controller, such as controller 134 of FIG. 1B, for use in a direct-view display, according to an illustrative embodiment of the invention. The controller 1000 includes an input processing module 1003, a memory control module 1004, a frame buffer 1005, a timing control module 1006, a pre-set imaging mode selector 1007, and a plurality of unique pre-set imaging mode stores 1009, 1010, 1011 and 1012, each containing data sufficient to implement a respective pre-set imaging mode. The controller also includes a switch 1008 responsive to the pre-set mode selector for switching between the various preset imaging modes. In some implementations the components may be provided as distinct chips or circuits which are connected together by means of circuit boards, cables, or other electrical interconnects. In other implementations several of these components can be designed together into a single semiconductor chip such that their boundaries are nearly indistinguishable except by function.

The controller 1000 receives an image signal 1001 from an external source, as well as host control data 1002 from the host device 120 and outputs both data and control signals for controlling light modulators and lamps of the display 128 into which it is incorporated.

The input processing module 1003 receives the image signal 1001 and processes the data encoded therein into a format suitable for displaying via the array of light modulators 100. The input processing module 1003 takes the data encoding each image frame and converts it into a series of sub-frame data sets. While in various embodiments, the input processing module 1003 may convert the image signal into non-coded sub-frame data sets, ternary coded sub-frame data sets, or other form of coded sub-frame data set, preferably, the input processing module converts the image signal into bitplanes, In addition, in some implementations, described further below in relation to FIG. 10, content providers and/or the host device encode additional information into the image signal 1001 to affect the selection of a pre-set imaging mode by the controller 1000. Such additional data is sometimes referred to a metadata. In such implementations, the input processing module 1003 identifies, extracts, and forwards this additional information to the pre-set imaging mode selector 1007 for processing.

The input processing module 1003 also outputs the sub-frame data sets to the memory control module 1004. The memory control module then stores the sub-frame data sets in the frame buffer 1005. The frame buffer is preferably a random access memory, although other types of serial memory can be used without departing from the scope of the invention. The memory control module 1004, in one implementation stores the sub-frame data set in a predetermined memory location based on the color and significance in a coding scheme of the sub-frame data set. In other implementations, the memory control module stores the sub-frame data set in a dynamically determined memory location and stores that location in a lookup table for later identification. In one particular implementation, the frame buffer 1005 is configured for the storage of bitplanes.

The memory control module 1004 is also responsible for, upon instruction from the timing control module 1006, retrieving sub-image data sets from the frame buffer 1005 and outputting them to the data drivers 132. The data drivers load the data output by the memory control module into the light modulators of the array of light modulators 100. The memory control module outputs the data in the sub-image data sets one row at a time. In one implementation, the frame buffer includes two buffers, whose roles alternate. While the memory control module stores newly generated bitplanes corresponding to a new image frame in one buffer, it extracts bitplanes corresponding to the previously received image frame from the other buffer for output to the array of light modulators. Both buffer memories can reside within the same circuit, distinguished only by address.

Data defining the operation of the display module for each of the pre-set imaging modes are stored in the pre-set imaging mode stores 1009, 1010, 1011, and 1012. For example, data for operating the display in one of a transmissive mode, reflective mode and transflective mode may be stored. Specifically, in one implementation, the data takes the form of a scheduling table. As described above, a scheduling table includes distinct timing values dictating the times at which data is loaded into the light modulators as well as when lamps are both illuminated and extinguished. In certain implementations, the pre-set imaging mode stores 1009-1012 store voltage and/or current magnitude values to control the brightness of the lamps. Collectively, the information stored in each of the pre-set imaging mode stores provide a choice between distinct imaging algorithms, for instance between display modes which differ in the properties of modulation of ambient light and/or light generated by an internal lamp, frame rate, lamp brightness, color temperature of the white point, bit levels used in the image, gamma correction, resolution, color gamut, achievable grayscale precision, or in the saturation of displayed colors. The storage of multiple pre-set mode tables, therefore, provides for flexibility in the method of displaying images, a flexibility which is especially advantageous when it provides a method for saving power for use in portable electronics. In some embodiments, the data defining the operation of the display module for each of the pre-set imaging modes are integrated into a baseband, media or applications processor, for example, by a corresponding IC company or by a consumer electronics OEM.

In another embodiment, not depicted in FIG. 8, memory (e.g. random access memory) is used to generically store the level of each color for any given image. This image data can be collected for a predetermined amount of image frames or elapsed time. The histogram provides a compact summarization of the distribution of data in an image. This information can be used by the pre-set imaging mode selector 1007 to select a pre-set imaging mode. This allows the controller 1000 to select future imaging modes based on information derived from previous images.

Figure 9:
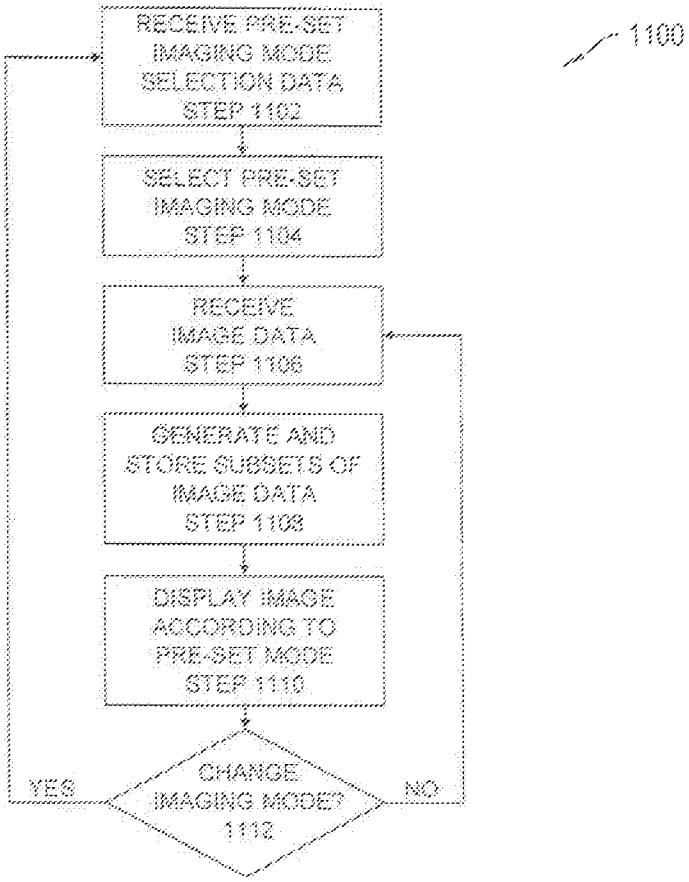
FIG. 9 is a flow chart of a process of displaying images suitable for use by a direct-view display according to an illustrative embodiment of the invention.

FIG. 9 is a flow chart of a process of displaying images 1100 suitable for use by a direct-view display such as the controller of FIG. 8, according to an illustrative embodiment of the invention. The display process 1100 begins with the receipt of mode selection data, i.e., data used by the pre-set imaging mode selector 1007 to select an operating mode (Step 1102). For example, in various embodiments, mode selection data includes, without limitation, one or more of the following types of data: a content type identifier, a host mode operation identifier, environmental sensor output data, user input data, host instruction data, and power supply level data. A content type identifier identifies the type of image being displayed. Illustrative image types include text, still images, video, web pages, computer animation, or an identifier of a software application generating the image. The host mode operation identifier identifies a mode of operation of the host. Such modes will vary based on the type of host device in which the controller is incorporated. For example, transmissive mode, reflective mode, transflective mode, for a cell phone, illustrative operating modes include a telephone mode, a camera mode, a standby mode, a texting mode, a web browsing mode, e-reader mode, document editing mode, and a video mode. Environmental sensor data includes signals from sensors such as photodetectors and thermal sensors. For example, the environmental data indicates levels of ambient light and temperature. User input data includes instructions provided by the user of the host device. This data may be programmed into software or controlled with hardware (e.g. a switch or dial). Host instruction data may include a plurality of instructions from the host device, such as a "shut down" or "turn on" signal. Power supply level data is communicated by the host processor and indicates the amount of power remaining in the host's power source.

Based on these data inputs, the pre-set imaging mode selector 1007 determines the appropriate pre-set imaging mode (Step 1104). For example, a selection is made between the pre-set imaging modes stored in the pre-set imaging mode stores 1009-1012. When the selection amongst pre-set imaging modes is made by the pre-set imaging mode selector, it can be made in response to the type of image to be displayed (for instance video or still images require finer levels of gray scale contrast versus an image which needs only a limited number of contrast levels (such as a text image)). Another factor which that might influence the selection of an imaging mode might be the lighting ambient of the device. For example, one might prefer one brightness for the display when viewed indoors or in an office environment versus outdoors where the display must compete in an environment of bright sunlight. Brighter displays are more likely to be viewable in an ambient of direct sunlight, but brighter displays consume greater amounts of power. The pre-set mode selector, when selecting pre-set imaging modes on the basis of ambient light, can make that decision in response to signals it receives through an incorporated photodetector. For example, in areas of high ambient light the controller of the display device may transition to a reflective mode in which the internal lamp is turned off and ambient light is modulated to form an image. In some embodiments, the controller of the display device may transition to a transflective mode where both ambient light and light from an internal light source are modulated. In one transflective mode, the intensity of the light source is reduced when compared to a transmissive mode, because the ambient light contributes to the total illumination level. In another transflective mode, the intensity of the light source may be increased to improve color differentiation and/or contrast. In certain embodiments, the internal light source includes at least first and second light sources corresponding to different colors. In some situations, the controller measures at least one color component of the detected ambient light, and adjusts the intensity of at least one of the first and second light sources based on the measurement of the at least one color component of the detected ambient light. For example, if the ambient includes a high percentage of blue light relative to other color components, the intensity of a blue light source in the display assembly is adjusted accordingly relative to other color light sources. In one embodiment of a transflective mode of operation 30% or more of the light used to form the image originates from the ambient. In another transflective embodiment more than 50% or more than 60% of the light used to form the image originates from the ambient. Another factor that might influence the selection of an imaging mode might be the level of stored energy in a battery powering the device in which the display is incorporated. As batteries near the end of their storage capacity it may be preferable to switch to an imaging mode which consumes less power to extend the life of the battery (e.g., a monochromatic reflective mode or to a transflective mode which uses less power to illuminate the light source).

The selection step 1104 can be accomplished by means of a mechanical relay, which changes the reference within the timing control module 1006 to one of the four pre-set image mode stores 1009-1012. Alternately, the selection step 1104 can be accomplished by the receipt of an address code which indicates the location of one of the pre-set image mode stores 1009-1012. The timing control module 1006 then utilizes the selection address, as received through the switch control 1008, to indicate the correct location in memory for the pre-set imaging mode.

The process 1100 then continues with the receipt of the data for an image frame (step 1106). The data is received by the input processing module 1003 by means of the input line 1001. The input processing module then derives a plurality of sub-frame data sets, for instance bitplanes, and stores them in the frame buffer 1005 (step 1108). In some implementations, the number of bit planes generated depends on the selected mode. In addition, the content of each bit plane may also be based in part on the selected mode. After storage of the sub-frame data sets, the timing control module 1006 proceeds to display each of the sub-frame data sets, at step 1110, in their proper order and according to timing and intensity values stored in the pre-set imaging mode store.

The process 1100 repeats itself based on decision block 1112. For example, in one implementation, the controller executes process 1100 for an image frame received from the host processor. When the process reaches decision block 1112, instructions from the host processor indicate that the image mode does not need to be changed. The process 1100 then continues receiving subsequent image data at step 1106. In another implementation, when the process reaches decision block 1112, instructions from the host processor indicate that the image mode does need to change to a different pre-set mode. The process 1100 then begins again at step 1102 by receiving new pre-set imaging mode selection data. The sequence of receiving image data at step 1106 through the display of the sub-frame data sets at step 1110 can be repeated many times, where each image frame to be displayed is governed by the same selected pre-set image mode table. This process can continue until directions to change the imaging mode are received at decision block 1112. In an alternative embodiment, decision block 1112 may be executed only on a periodic basis, e.g., every 10 frames, 30 frames, 60 frames, or 90 frames. Or in another embodiment, the process begins again at step 1102 only after the receipt of an interrupt signal emanating from one or the other of the input processing module 1003 or the image mode selector 1007. An interrupt signal may be generated, for instance, whenever the host device makes a change between applications or after a substantial change in the data output by one of the environmental sensors.

Figure 10:
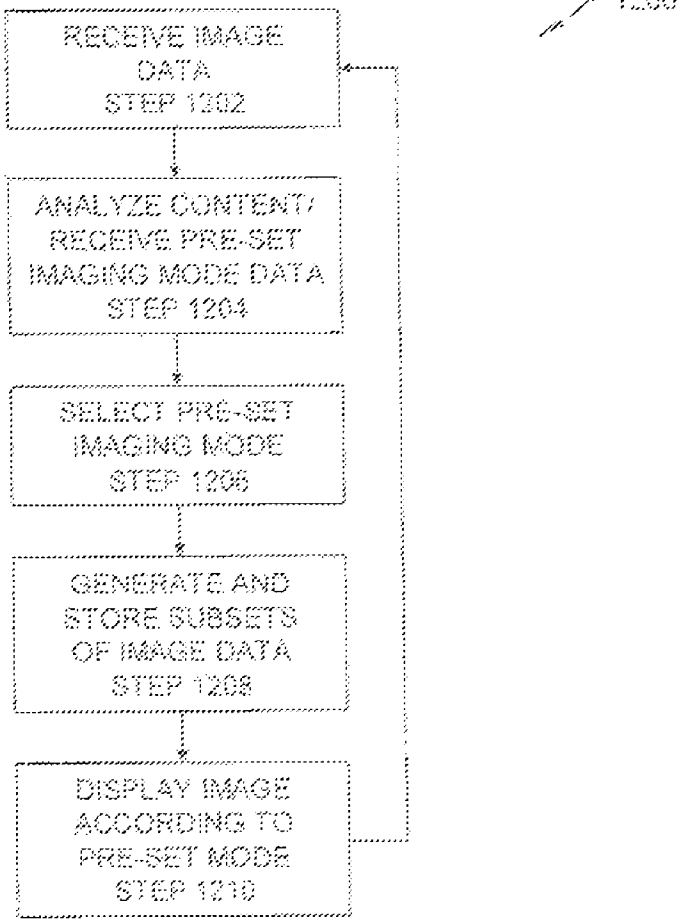
FIG. 10 depicts a display method by which the controller can adapt the display characteristics based on the content of incoming image data.
Figure 12:
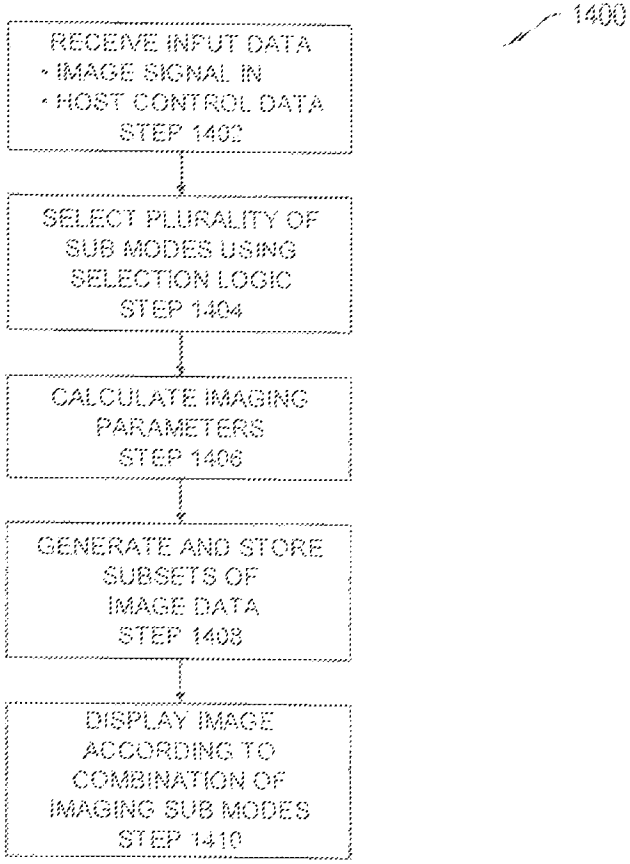
FIG. 12 is a flow chart of a process of displaying images suitable for use by a direct-view display controller according to an illustrative embodiment of the invention.

FIG. 10 depicts a display method 1200 by which the controller 1000 can adapt the display characteristics based on the content of incoming image data. Referring to FIGS. 10 and 12, the display method 1200 begins with the receipt of the data for an image frame at step 1202. The data is received by the input processing module 1003 via the input line 1001. In one instance, at step 1204 the input processing module monitors and analyzes the content of the incoming image to look for an indicator of the type of content. For example, at step 1204 the input processing module would determine if the image signal contains text, video, still image, or web content. Based on the indicator the pre-set imaging mode selector 1007 would determine the appropriate pre-set mode in step 1206. For example, if the image signal requires only a black and white display, the controller may transition to a reflective mode which modulates ambient light and emits a monochromatic image to the viewer. This allows for reduction in battery power consumption for images that do not require illumination of the backlight.

In another implementation, the image signal 1001 received by the input processing module 1003 includes header data encoded according to a codec for selection of pre-set display modes. The encoded data may contain multiple data fields including user defined input, type of content, type of image, or an identifier indicating the specific display mode to be used. In step 1204 the image processing module 1003 recognizes the encoded data and passes the information on to the pre-set imaging mode selector 1007. The pre-set mode selector then chooses the appropriate pre-set mode based on one or multiple sets of data in the codec (step 1206). The data in the header may also contain information pertaining to when a certain pre-set mode should be used. For example, the header data indicates that the pre-set mode be updated on a frame-by-frame basis, after a certain number of frames, or the pre-set mode should continue indefinitely until information indicates otherwise.

In step 1208 the input processing module 1003 derives a plurality of sub-frame data sets based on the pre-set imaging mode, for instance bitplanes, from the data and stores the bitplanes in the frame buffer 1005. After a complete image frame has been received and stored in the frame buffer 1005 the method 1200 proceeds to step 1210. Finally, at step 1210 the sequence timing control module 1006 assesses the instructions contained within the pre-set imaging mode store and sends signals to the drivers according to the ordering parameters and timing values that have been re-programmed within the pre-set image mode.

The method 1200 then continues iteratively with receipt of subsequent frames of image data. The processes of receiving (step 1202) and displaying image data (step 1210) may run in parallel, with one image being displayed from the data of one buffer memory according to the pre-set imaging mode at the same time that new sub-frame data sets are being analyzed and stored into a parallel buffer memory. The sequence of receiving image data at step 1202 through the display of the sub-frame data sets at step 1210 can be repeated interminably, where each image frame to be displayed is governed by a pre-set imaging mode.

It is instructive to consider some examples of how the method 1200 can reduce power consumption by choosing the appropriate pre-set imaging mode in response to data collected at step 1204. These examples are referred to as adaptive power schemes.

Example 1

A process is provided within the input processing module 1003 which determines whether the image is comprised solely of text or text plus symbols as opposed to video or a photographic image. The pre-set imaging mode selector can then select a pre-set mode accordingly. Text images, especially black and white text images, do not need to be refreshed as often as video images and typically require only a limited number of different colors or gray shades. The appropriate pre-set imaging mode can therefore adjust both the frame rate as well as the number of sub-images to be displayed for each image frame. Text images require fewer sub-images in the display process than photographic images.

Example 2

The pre-set imaging mode selector 1007 receives direct instructions from the host processor 122 to select a certain mode. For example, the host processor may directly tell the pre-set imaging mode selector to "use the transflective mode".

Example 3

The pre-set imaging mode selector 1007 receives data from a photo sensor indicating low levels of ambient light. Because it is easier to see a display in low levels of ambient light, the pre-set imaging mode selector can choose a "transmissive mode" with a "dimmed lamp" pre-set mode in order to conserve power in a low-light environment.

Example 4

A specific pre-set mode could be selected based on the operating mode of the host. For instance, a signal from the host would indicate if it was in phone call mode, picture viewing mode, video mode, or on stand by and the pre-set mode selector would then decide on best pre-set mode to fit to the present state of the host. More specifically, different pre-set modes could be used for displaying text, video, icons, or web pages.

Figure 11:
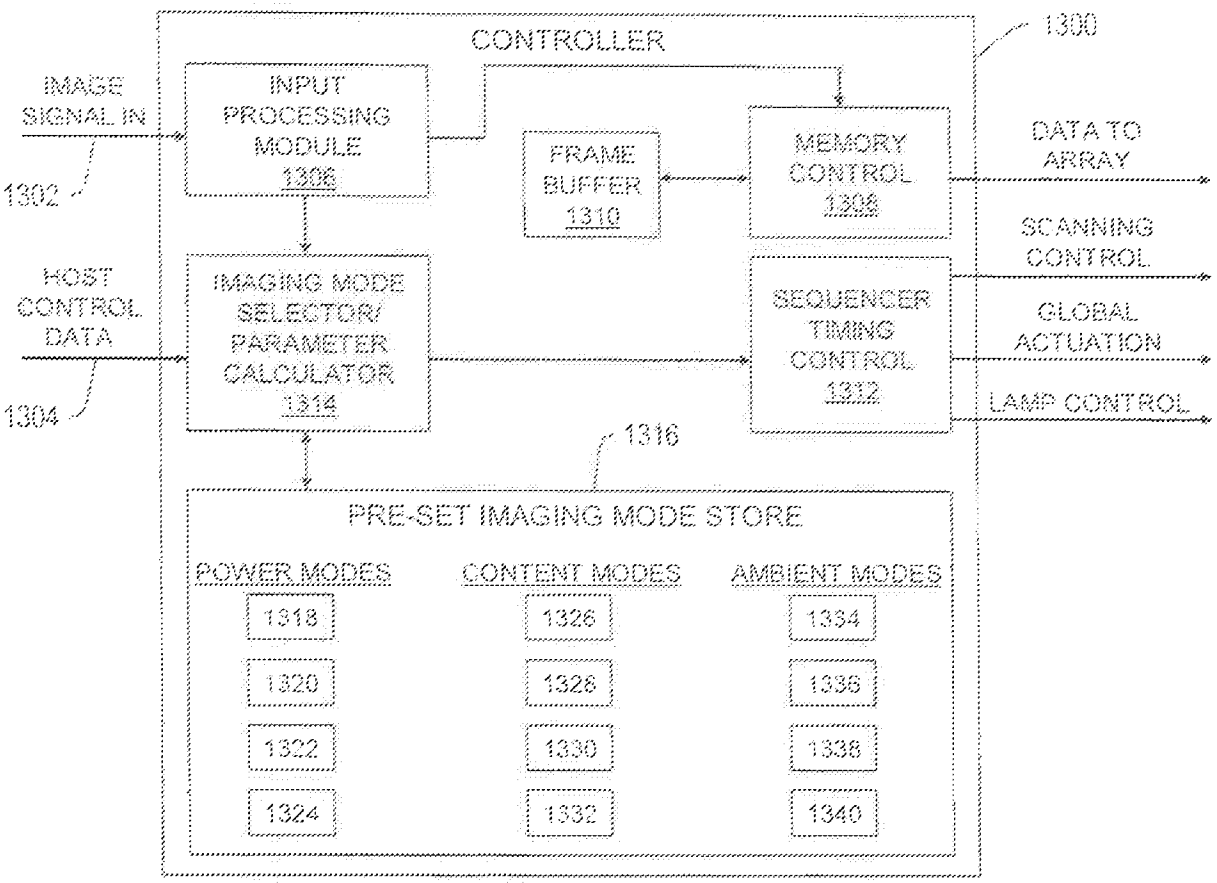
FIG. 11 is a block diagram of a controller for use in a direct-view display, according to an illustrative embodiment of the invention.

FIG. 11 is a block diagram of a controller, such as controller 134 of FIG. 1B, for use in a direct-view display, according to an illustrative embodiment of the invention. The controller 1300 includes an input processing module 1306, a memory control module 1308, a frame buffer 1310, a timing control module 1312, an imaging mode selector/parameter calculator 1314, and a pre-set imaging mode store 1316. The imaging mode store 1316 contains separate categories of sub modes including power, content and ambient sub modes. The "power" sub modes include "low" 1318, "medium" 1320, "high" 1322, and "full" 1324. The "content" sub modes include "text" 1326, "web" 1328, "video" 1330, and "still image" 1332. The "ambient" sub modes include "dark" 1334, "indoor" 1336, "outdoor" 1338, and "bright sun" 1340. These sub modes may be selectively combined to form a pre-set imaging mode with desired characteristics. For example, the controller may transition from a transmissive to transflective mode in a "bright sun" setting.

In some implementations the components may be provided as distinct chips or circuits which are connected together by means of circuit boards, cables, or other electrical interconnects. In other implementations several of these components can be designed together into a single semiconductor chip such that their boundaries are nearly indistinguishable except by function. The controller 1300 receives an image signal 1302 from an external source, as well as host control data 1304 from the host device 120 and outputs both data and control signals for controlling light modulators and lamps of the display 128 into which it is incorporated. The input processing module 1003 receives the image signal 1001 and processes the data encoded therein into a format suitable for displaying via the array of light modulators 100. The input processing module 1003 takes the data encoding each image frame and converts it into a series of sub-frame data sets. While in various embodiments, the input processing module 1003 may convert the image signal into non-coded sub-frame data sets, ternary coded sub-frame data sets, or other form of coded sub-frame data set, preferably, the input processing module converts the image signal into bitplanes. The input processing module 1003 also outputs the sub-frame data sets to the memory control module 1004. The memory control module then stores the sub-frame data sets in the frame buffer 1005. The frame buffer is preferably a random access memory, although other types of serial memory can be used without departing from the scope of the invention. The memory control module 1004, in one implementation stores the sub-frame data set in a predetermined memory location based on the color and significance in a coding scheme of the sub-frame data set. In other implementations, the memory control module stores the sub-frame data set in a dynamically determined memory location and stores that location in a lookup table for later identification. In one particular implementation, the frame buffer 1005 is configured for the storage of bitplanes.

The memory control module 1004 is also responsible for, upon instruction from the timing control module 1006, retrieving sub-image data sets from the frame buffer 1005 and outputting them to the data drivers 132. The data drivers load the data output by the memory control module into the light modulators of the array of light modulators 100. The memory control module outputs the data in the sub-image data sets one row at a time. In one implementation, the frame buffer includes two buffers, whose roles alternate. While the memory control module stores newly generated bitplanes corresponding to a new image frame in one buffer, it extracts bitplanes corresponding to the previously received image frame from the other buffer for output to the array of light modulators. Both buffer memories can reside within the same circuit, distinguished only by address.

Data defining the operation of the display module for each of the pre-set imaging modes are stored in the pre-set imaging mode store 1316. The pre-set imaging mode store is divided up into separate sub modes within different categories. In one embodiment, the categories include "power modes", which specifically modify the image so that less power is consumed by the display, "content modes", which contain specific instructions to display images based on the type of content, and "environmental modes", which modify the image based on various environmental aspects, such as battery power level and ambient light and heat. For example, a sub mode in the "power modes" category may hold instructions for the use of lower illumination values for the lamps 140-146 in order to conserve power. A sub mode in the "content modes" category may hold instructions for a smaller color gamut, which would save power while adequately displaying images that do not require a large color gamut such as text. In the controller 1300, the imaging mode selector/parameter calculator 1314 selects a combination of imaging pre-set sub modes based on input image or host control data. The instructions of the combined pre-set imaging sub modes are then processed by imaging mode selector/parameter calculator 1314 to derive a schedule table and drive voltages for displaying the image. Alternatively, the preset imaging mode store 1316 may store preset imaging modes corresponding to various combinations of submodes. Each combination may be associated with its own imaging mode, or multiple combinations may be linked with the same preset imaging mode.

FIG. 12 is a flow chart of a process of displaying images 1400 suitable for use by a direct-view display controller such as the controller of FIG. 11, according to an illustrative embodiment of the invention. Referring to FIGS. 11 and 12, the display process 1400 begins with the receipt of image signal and host control data (step 1402). The imaging mode selector/parameter calculator 1314 then calculates a plurality of pre-set imaging sub modes based on the input data (step 1404). For example, in various embodiments, mode calculation data includes, without limitation, one or more of the following types of data: a content type identifier, a host mode operation identifier, environmental sensor output data, user input data, host instruction data, and power supply level data. The imaging parameter calculator has the ability to "mix and match" sub modes from different categories to obtain the desired imaging display mode. For example, if the host control data 1304 indicates that the host is in standby mode and the image data 1302 indicates a still image, the imaging mode selector/parameter calculator 1314 would select sub modes from the pre-set imaging mode store 1316 in the power modes category, to reduce power usage, and in the content modes category, to adjust the imaging parameters for a still image. In step 1406, the parameter calculator 1314, determines the proper timing and drive parameter values based on the selected sub modes.

In step 1408 the input processing module 1306 derives a plurality of sub-frame data sets based on the selected sub modes, for instance bitplanes, from the data and stores the bitplanes in the frame buffer 1310. After a complete image frame has been received and stored in the frame buffer 1310 the method 1400 proceeds to step 1410. Finally, at step 1410 the sequence timing control module 1312 assesses the instructions contained within the pre-set imaging mode store and sends signals to the drivers according to the ordering parameters and timing values that have been re-programmed within the plurality of selected pre-set imaging sub modes.

It is instructive to consider some examples of how a display apparatus can transition from one of a transmissive, reflective and transflective mode to another of said modes.

Example 1

A controller, such as controller 134, which controls the states of a plurality of light modulators in a display apparatus and the internal light source controls the display apparatus to display at least one image in a transmissive mode of operation. The transmissive mode of operation includes illuminating the internal light source and outputting data signals indicative of desired states of the plurality of light modulators through a first set data voltage interconnects coupled to the plurality of light modulators. As a result of the data signals, the plurality of light modulators modulate light emitted by the internal light source. The light modulators may also modulate a small amount of ambient light relative to the light originating from the light source, i.e., less than about 30% of the total light modulated. When the controller detects a signal instructing the display apparatus to transition to a reflective mode of operation, the controller controls the display apparatus to transition, in response to the signal, to the reflective mode of operation to display one or more images. In the reflective mode of operation the internal light source is kept un-illuminated throughout the display of an image frame. Thus the only light modulated is light originating from the ambient.

Example 2

A controller, such as controller 134, which controls the states of a plurality of light modulators in a display apparatus and the internal light source controls the display apparatus to display at least one image in a reflective mode of operation. In the reflective mode of operation the internal light source is kept un-illuminated throughout the display of an image. As a result of the data signals, the plurality of light modulators modulate light originating from the ambient. When the controller detects a signal instructing the display apparatus to transition to a transmissive mode of operation, the controller controls the display apparatus to transition, in response to the signal, to the transmissive mode of operation to display one or more images. The transmissive mode of operation includes illuminating the internal light source and outputting data signals indicative of desired states of the plurality of light modulators. As a result of the data signals, the plurality of light modulators modulate light emitted by the internal light source. The light modulators may also modulate a small amount of ambient light relative to the light originating from the light source, i.e., less than about 30% of the total light modulated.

Example 3

A controller, such as controller 134, which controls the states of a plurality of light modulators in a display apparatus and the internal light source controls the display apparatus to display at least one image in a reflective mode of operation. In the reflective mode of operation the internal light source is kept un-illuminated throughout the display of an image frame. Thus, the only light modulated to form an image is ambient light. When the controller detects a signal instructing the display apparatus to transition to a transflective mode of operation, the controller controls the display apparatus to transition, in response to the signal, to the transflective mode of operation, in which at least about 30% of the light modulated by the light modulators originates from the ambient, to display one or more images.

Example 4

A controller, such as controller 134, which controls the states of a plurality of light modulators in a display apparatus and the internal light source controls the display apparatus to display at least one image in a transmissive mode of operation. The transmissive mode of operation includes illuminating the internal light source and outputting data signals indicative of desired states of the plurality of light modulators through a first set data voltage interconnects coupled to the plurality of light modulators. As a result of the data signals, the plurality of light modulators modulate light emitted by the internal light source. The light modulators may also modulate a small amount of ambient light relative to the light originating from the light source, i.e., less than about 30% of the total light modulated. When the controller detects a signal instructing the display apparatus to transition to a transflective mode of operation, the controller controls the display apparatus to transition, in response to the signal, to the transflective mode of operation, in which at least about 30% of the light modulated by the light modulators originates from the ambient, to display one or more images. The transflective mode of operation includes illuminating the internal light source and outputting data signals indicative of desired states of the plurality of light modulators through the same first set data voltage interconnects coupled to the plurality of light modulators. As a result of the data signals, the plurality of light modulators modulate both light emitted by the internal light source and a substantial amount of light originating from the ambient.

While only a few of the many possible examples are described in detail above, one of ordinary skill in the art will recognize the a display apparatus can transition from any one of a transmissive, reflective or transflective mode to any other of the three modes or to different versions of the same mode (e.g., from a first transflective mode to a second transflective mode) without departing from the scope of the invention.

The invention may be embodied in other specific forms without departing from the spirit or essential characteristics thereof. The specific embodiments and example described above may be combined in any many without departing from the scope of the invention. Additionally, the foregoing embodiments are to be considered in all respects illustrative, rather than limiting of the invention.

The invention claimed is:

1. A direct-view display apparatus, comprising:

a transparent substrate;

a metal layer over the transparent substrate having a plurality of apertures therein;

an internal light source;

a plurality of light modulators over the transparent substrate, each light modulator of the plurality of light modulators over at least one respective aperture of the plurality of apertures, each of the plurality of light modulators including at least one transflective element within a region defined by the at least one respective aperture, each transflective element capable of reflecting ambient light; and a controller for controlling the states of the plurality of light modulators and the internal light source, the controller being configured to:

cause the display apparatus to display at least one image in a transmissive mode of operation by causing the internal light source to emit light at a first intensity and by outputting data signals indicative of desired states of the plurality of light modulators through a first set of data voltage interconnects coupled to the plurality of light modulators such that the plurality of light modulators modulate the light emitted by the internal light source at the first intensity;

detect a first signal configured to cause a transition from the transmissive mode of operation;

transition, in response to the first signal, to a transflective mode of operation, the transition to the transflective mode including decreasing the intensity of the internal light source from the first intensity to a second intensity; and cause the display apparatus to display at least one image in the transflective mode of operation by outputting data signals indicative of desired states of the plurality of light modulators through the same first set of data voltage interconnects to the plurality of light modulators to modulate light originating from an ambient light source and the light originating from the internal light source at the second intensity.

2. The apparatus of claim 1, wherein the controller is further configured to:

detect a second signal configured to cause a transition from the transmissive or the transflective mode of operation;

transition, in response to the second signal, to a reflective mode of operation, the transition to the reflective mode including causing the internal light source to stop emitting light; and cause the display apparatus to display at least one image in the reflective mode of operation by outputting data signals indicative of desired states of the plurality of light modulators through the same first set of data voltage interconnects to the plurality of light modulators to modulate light originating from the ambient light source.

3. The apparatus of claim 2, wherein the controller controls at least one light modulator of the plurality of light modulators capable of operating in both the transmissive mode and the reflective mode.

4. The apparatus of claim 2, wherein the second signal is based at least in part on detected ambient light.

5. The apparatus of claim 2, wherein displaying at least one image in the transmissive mode includes modulating light in accordance with a first number of grayscale divisions for the image, and wherein displaying at least one image in the transflective or reflective modes includes modulating light in accordance with a second number of grayscale divisions, wherein the second number of grayscale divisions is less than the first number of grayscale divisions.

6. The apparatus of claim 2, wherein displaying at least one image in the reflective mode includes at least one of modulating the image as a black and white image, and modulating light with at least 3 grayscale divisions.

7. The apparatus of claim 2, wherein displaying at least one image in the transmissive mode includes modulating the light according to a first frame rate.

8. The apparatus of claim 7, wherein displaying at least one image in the transflective or reflective modes includes modulating light in accordance with a second frame rate, wherein the second frame rate that is less than the first frame rate.

9. The apparatus of claim 2, wherein transitioning to the reflective mode of operation includes loading, from a memory, operating parameters corresponding to the reflective mode.

10. The apparatus of claim 2, wherein displaying at least one image in the reflective mode includes converting a color image into a black and white image for display.

11. The apparatus of claim 2, wherein displaying at least one image in the transmissive mode includes modulating the plurality of light modulators according to a first sequence of timing signals which control the loading of image data to the plurality of light modulators.

12. The apparatus of claim 11, wherein displaying at least one image in the transflective or reflective modes includes modulating the plurality of light modulators according to the same first sequence of timing signals which control the loading of image data to the plurality of light modulators.

13. The apparatus of claim 11, wherein displaying at least one image in the transflective or reflective modes includes modulating the plurality of light modulators according to a second sequence of timing signals that is different from the first sequence.

14. The apparatus of claim 13, wherein displaying at least one image in the transflective or reflective modes includes loading a subset of image data to the plurality of light modulators.

15. The apparatus of claim 1, wherein while in the transmissive mode, the plurality of light modulators are configured to modulate light emitted by the internal light source and light originating from the ambient light source.

16. The apparatus of claim 1, wherein the display apparatus consumes less power while operating in the transflective mode than while operating in the transmissive mode.

17. The apparatus of claim 1, wherein the controller is further capable of transitioning to an operating mode associated with a display of at least one image with more colors than another operating mode.

18. The apparatus of claim 1, wherein the controller derives the first signal from at least one of information to be displayed by the display apparatus and an amount of energy stored in a battery.

19. The apparatus of claim 1, wherein decreasing the first intensity of the light source during the transition to the transflective mode of operation includes decreasing the first intensity such that at least about 30% of the light modulated by the plurality of light modulators originates from the ambient light source.

20. The apparatus of claim 1, wherein the first signal is based at least in part on detected ambient light.

21. The apparatus of claim 20, wherein the internal light source includes at least first and second light sources corresponding to different colors, and wherein the controller measures at least one color component of the detected ambient light, and adjusts the first intensity of at least one of the first and second light sources based on the measurement of the at least one color component of the detected ambient light.

22. The apparatus of claim 1, wherein displaying at least one image in the transflective mode includes at least one of modulating the image as a black and white image, and modulating light with at least 3 grayscale divisions.

23. The apparatus of claim 1, wherein displaying at least one image in the transflective mode includes modulating light to form a color image, and wherein the image is modulated with only 1 grayscale division per color.

24. The apparatus of claim 1, wherein displaying at least one image in the transflective mode includes modulating light to form a color image, and wherein the image is modulated with at least 2 grayscale divisions per color.

25. The apparatus of claim 1, wherein the light emitted by the internal light source passes through a plane defined by the plurality of light modulators.

26. A direct-view display apparatus, comprising:

a transparent substrate;

an internal light source;

a plurality of light modulators coupled to the transparent substrate, each of the plurality of light modulators including at least one microelectromechanical systems (MEMS)-based shutter;

a controller for controlling the states of the plurality of light modulators and the internal light source, the controller being configured to:

cause the display apparatus to display at least one image in a transmissive mode of operation by causing the internal light source to emit light at a first intensity and by outputting data signals indicative of desired states of the plurality of light modulators through a first set of data voltage interconnects coupled to the plurality of light modulators such that the plurality of light modulators modulate the light emitted by the internal light source at the first intensity;

detect a first signal configured to cause a transition from the transmissive mode of operation;

transition, in response to the first signal, to a transflective mode of operation, the transition to the transflective mode including decreasing the intensity of the internal light source from the first intensity to a second intensity;

cause the display apparatus to display at least one image in the transflective mode of operation by outputting data signals indicative of desired states of the plurality of light modulators through the same first set of data voltage interconnects to the plurality of light modulators to modulate light originating from an ambient light source and the light originating from the internal light source at the second intensity.

27. apparatus of claim 26, each of the plurality of light modulators further including:

a metal layer having at least one aperture defined therein; and at least one electrode;

the at least one MEMS-based shutter being translatable over the at least one aperture between at least an open position in which the shutter allows light to pass through the at least one aperture and a closed position in which the shutter blocks light from passing through the at least one aperture, the position of the at least one MEMS-based shutter being based on an electrical potential between the MEMS-based shutter and the at least one electrode.

28. The apparatus of claim 27, the metal layer having a front-facing surface and a rear-facing reflective surface, the apparatus further including:

a second reflective layer having a front-facing reflective surface; and an optical cavity in the transparent substrate between the metal layer and the second reflective layer, the front-facing reflective surface of the second reflective layer and the rear-facing reflective surface of the metal layer capable of recycling light within the optical cavity.

29. The apparatus of claim 28, the internal light source being configured to emit the light into the optical cavity.

30. The apparatus of claim 29, each of the plurality of light modulators further including:

one or more transflective elements within a region defined by the at least one aperture.

31. The apparatus of claim 30, wherein, while in the transflective mode of operation:

the at least one MEMS-based shutter is configured to enable at least a portion of the ambient light to enter the optical cavity through the at least one aperture in regions between the one or more transflective elements or in regions between the one or more transflective elements and the metal layer; and the optical cavity is configured to recycle the ambient light and to emit the recycled ambient light through the at least one aperture.

32. The apparatus of claim 30, wherein, while in the transflective mode of operation:

the at least one MEMS-based shutter is configured to enable at least a portion of the ambient light to reflect off of the one or more transflective elements.

33. A method for controlling a display apparatus, comprising:

displaying, by the display apparatus, at least one image in a transmissive mode of operation by causing an internal light source to emit light at a first intensity and by outputting data signals indicative of desired states of a plurality of light modulators such that the plurality of light modulators modulate the light emitted by the internal light source at the first intensity;

detecting a first signal configured to cause a transition from the transmissive mode of operation;

transitioning, in response to the first signal, to a transflective mode of operation, the transitioning including decreasing the intensity of the internal light source from the first intensity to a second intensity; and displaying, by the display apparatus, at least one image in the transflective mode of operation by outputting data signals indicative of desired states of the plurality of light modulators such that the plurality of light modulators modulate light originating from an ambient light source and the light originating from the internal light source at the second intensity;

the display apparatus including a transparent substrate and a metal layer over the transparent substrate having a plurality of apertures therein;

each light modulator of the plurality of light modulators over at least one respective aperture of the plurality of apertures, each of the plurality of light modulators including at least one transflective element within a region defined by the at least one respective aperture, each transflective element capable of reflecting a portion of the ambient light.

34. The method of claim 33, further comprising:

detecting a second signal configured to cause a transition from the transmissive or the transflective mode of operation;

transitioning by the display apparatus, in response to the second signal, to a reflective mode of operation, the transitioning to the reflective mode including causing the internal light source to stop emitting light; and displaying, responsive to transitioning to the reflective mode, at least one image by outputting data signals indicative of desired states of the plurality of light modulators to the plurality of light modulators to modulate light originating from the ambient light source.

35. The method of claim 34, wherein the second signal is based at least in part on detected ambient light.

36. The method of claim 34, wherein displaying at least one image in the transmissive mode includes modulating light in accordance with a first number of grayscale divisions for the image, and wherein displaying at least one image in the transflective or reflective modes includes modulating light in accordance with a second number of grayscale divisions, wherein the second number of grayscale divisions is less than the first number of grayscale divisions.

37. The method of claim 34, wherein displaying at least one image in the reflective mode includes at least one of modulating the image as a black and white image, and modulating light with at least 3 grayscale divisions.

38. The method of claim 34, wherein displaying at least one image in the transmissive mode includes modulating the light according to a first frame rate.

39. The method of claim 38, wherein displaying at least one image in the transflective or reflective modes includes modulating light in accordance with a second frame rate, wherein the second frame rate that is less than the first frame rate.

40. The method of claim 34, wherein transitioning to the reflective mode of operation includes loading, from a memory, operating parameters corresponding to the reflective mode.

41. The method of claim 34, wherein displaying at least one image in the reflective mode includes converting a color image into a black and white image for display.

42. The method of claim 34, wherein displaying at least one image in the transmissive mode includes modulating the plurality of light modulators according to a first sequence of timing signals which control the loading of image data to the plurality of light modulators.

43. The method of claim 42, wherein displaying at least one image in the transflective or reflective modes includes modulating the plurality of light modulators according to the same first sequence of timing signals which control the loading of image data to the plurality of light modulators.

44. The method of claim 42, wherein displaying at least one image in the transflective or reflective modes includes modulating the plurality of light modulators according to a second sequence of timing signals that is different from the first sequence.

45. The method of claim 44, wherein displaying at least one image in the transflective or reflective modes includes loading a subset of image data to the plurality of light modulators.

46. The method of claim 33, further including transitioning to an operating mode associated with a display of at least one image with more colors than another operating mode.

47. The method of claim 33, further including deriving the first signal from at least one of information to be displayed by the display apparatus and an amount of energy stored in a battery.

48. The method of claim 33, wherein decreasing the first intensity of the light source during the transition to the transflective mode of operation includes decreasing the first intensity such that at least about 30% of the light modulated by the plurality of light modulators originates from the ambient light source.

49. The method of claim 33, wherein the first signal is based at least in part on detected ambient light.

50. The method of claim 49, wherein the internal light source includes at least first and second light sources corresponding to different colors, and wherein the controller measures at least one color component of the detected ambient light, and adjusts the first intensity of at least one of the first and second light sources based on the measurement of the at least one color component of the detected ambient light.

51. The method of claim 33, wherein displaying at least one image in the transflective mode includes at least one of modulating the image as a black and white image, and modulating light with at least 3 grayscale divisions.

52. The method of claim 33, wherein displaying at least one image in the transflective mode includes modulating light to form a color image, and wherein the image is modulated with only 1 grayscale division per color.

53. The method of claim 33, wherein displaying at least one image in the transflective mode includes modulating light to form a color image, and wherein the image is modulated with at least 2 grayscale divisions per color.

54. The method of claim 33, wherein the light emitted by the internal light source passes through a plane defined by the plurality of light modulators.

55. A method for controlling a display apparatus, comprising:

displaying, by the display apparatus, at least one image in a transmissive mode of operation by causing an internal light source to emit light at a first intensity and by outputting data signals indicative of desired states of a plurality of light modulators such that the plurality of light modulators modulate the light emitted by the internal light source at the first intensity, each of the plurality of light modulators including at least one microelectromechanical systems (MEMS)-based shutter;

detecting a first signal configured to cause a transition from the transmissive mode of operation;

transitioning, in response to the first signal, to a transflective mode of operation, the transitioning including decreasing the intensity of the internal light source from the first intensity to a second intensity; and displaying, responsive to transitioning to the transflective mode, at least one image in the transflective mode of operation by outputting data signals indicative of desired states of the plurality of light modulators such that the plurality of light modulators modulate light originating from an ambient light source and the light originating from the internal light source at the second intensity.

56. The method of claim 55, each of the plurality of light modulators further including:

a metal layer having at least one aperture defined therein; and at least one electrode;

the MEMS-based shutter being translatable over the at least one aperture between at least an open position in which the shutter allows light to pass through the at least one aperture and a closed position in which the shutter blocks light from passing through the at least one aperture, the position of the MEMS-based shutter being based on an electrical potential between the MEMS-based shutter and the at least one electrode.

57. The method of claim 56, the metal layer having a front-facing surface and a rear-facing reflective surface, each of the plurality of light modulators further including:

a second reflective layer having a front-facing reflective surface; and an optical cavity between the metal layer and the second reflective layer, the front-facing reflective surface of the second reflective layer and the rear-facing reflective surface of the metal layer capable of recycling light within the optical cavity.

58. The method of claim 57, the internal light source being configured to emit the light into the optical cavity.

59. The method of claim 58, each of the plurality of light modulators further including:

one or more transflective elements within a region defined by the at least one aperture.

60. The method of claim 59, wherein, while in the transflective mode of operation:

the MEMS-based shutter is configured to enable at least a portion of the ambient light to enter the optical cavity through the at least one aperture in regions between the one or more transflective elements or in regions between the one or more transflective elements and the metal layer; and the optical cavity is configured to recycle the ambient light and to emit the recycled ambient light through the at least one aperture.

61. The method of claim 59, wherein, while in the transflective mode of operation the MEMS-based shutter is configured to enable at least a portion of the ambient light to reflect off of the one or more transflective elements.

* * * * *